US007629101B2

(12) United States Patent
Miura et al.

(10) Patent No.: US 7,629,101 B2
(45) Date of Patent: Dec. 8, 2009

(54) LIQUID DEVELOPER, METHOD OF MANUFACTURING LIQUID DEVELOPER, AND IMAGE FORMING APPARATUS

(75) Inventors: Satoru Miura, Matsumoto (JP); Hiroshi Kaiho, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 531 days.

(21) Appl. No.: 11/678,988

(22) Filed: Feb. 26, 2007

(65) Prior Publication Data

US 2007/0258731 A1 Nov. 8, 2007

(30) Foreign Application Priority Data

Feb. 27, 2006 (JP) ..... 2006-050889
Oct. 23, 2006 (JP) ..... 2006-288140

(51) Int. Cl.
*G03G 9/00* (2006.01)

(52) U.S. Cl. ..... 430/114; 430/116; 430/137.22; 399/237

(58) Field of Classification Search ..... 430/114, 430/116, 137.22; 399/237
See application file for complete search history.

(56) References Cited

U.S. PATENT DOCUMENTS 7,563,552 B2 * 7/2009 Kaiho et al. ..... 430/116

FOREIGN PATENT DOCUMENTS

JP 08-036277 2/1996
JP 11-212035 8/1999

* cited by examiner

*Primary Examiner*—Mark A Chapman
(74) *Attorney, Agent, or Firm*—Hogan & Hartson LLP

(57) ABSTRACT

A liquid developer includes an insulation liquid, and toner particles that are dispersed in the insulation liquid. Fatty acid monoester is unevenly distributed in the vicinity of surfaces of the toner particles, and the insulation liquid contains unsaturated fatty acid triglyceride.

12 Claims, 3 Drawing Sheets

LIQUID DEVELOPER, METHOD OF MANUFACTURING LIQUID DEVELOPER, AND IMAGE FORMING APPARATUS

BACKGROUND

1. Technical Field

The present invention relates to a liquid developer, a method of manufacturing a liquid developer, and an image forming apparatus.

2. Related Art

A developer for developing an electrostatic latent image formed on a latent image carrier is classified into one for a method using a dry toner, which is composed of a material containing a colorant, such as a pigment or the like, and binder resin, in a dry state, and another for a method using a liquid developer, in which a toner is dispersed in an electrical insulation carrier liquid (insulation liquid).

In the method using such a dry toner, since a solid state toner is handled, it is advantageous in handleability. Meanwhile, there are many problems in view of an adverse affect of toner powder on a human body, contamination by dispersion of toner, and uniformity when the toner is dispersed. Further, in such a dry toner, since aggregation of toner particles is likely to occur, it is difficult to obtain toner particles each having a sufficiently small size. Further, it is difficult to form a toner image with high resolution. In addition, when the sizes of the toner particles are comparatively small, the above problems by the toner powder drastically appear.

Meanwhile, in a developing method using such a liquid developer, since aggregation of toner particles in the liquid developer can be effectively prevented, fine toner particles can be used and a binder resin having a low softening point (a low softening temperature) can be used. As a result, the developing method using the liquid developer has such advantages as good reproducibility of an image having thin lines, good gray-scale reproducibility, and excellent color reproducibility. Further, the developing method using the liquid developer is also a method of forming an image at high speed.

However, since an insulation liquid used in the known liquid developer mainly contains petroleum-based carbon hydride, there is concern that the insulation liquid may have an adverse affect on environment if it flows out of an image forming apparatus.

Further, usually, when the liquid developer is used, the insulation liquid is adhering to a surface of each toner particle upon fixing. In the known liquid developer, there is a problem in that such an insulation liquid adhering to the surfaces of the toner particles lowers a fixing strength of the toner particles. In order to improve the fixing strength of the toner, a method that heats the toner particles at a comparatively high temperature for hours to fix the toner particles has been considered. However, this method cannot satisfy demands for high-speed image formation and power saving.

In order to solve the above-described problem, JP-A-11-212035 discloses a method that uses natural fatty oil as the insulation liquid.

A liquid developer described in JP-A-11-212035 uses an oxidization polymerization reaction of the natural fatty oil to improve a fixing property. However, since the natural fatty oil has low permeability for a recording medium, it is difficult to obtain a sufficiently high fixing strength.

SUMMARY

An advantage of some aspects of the invention is that it provides an environment-friendly liquid developer, in which toner particles have an excellent fixing property onto a recording medium, a method of manufacturing a liquid developer capable of efficiently manufacturing an environment-friendly liquid developer, in which toner particles have an excellent fixing property onto a recording medium, and an image forming apparatus capable of forming a toner image having an excellent fixing strength and being suitable for low-temperature and high-speed fixing.

The advantage can be achieved by the following aspects of the invention.

According to a first aspect of the invention, a liquid developer includes an insulation liquid, and toner particles that are dispersed in the insulation liquid. Fatty acid monoester is unevenly distributed in the vicinity of surfaces of the toner particles, and the insulation liquid contains unsaturated fatty acid triglyceride.

In the liquid developer according to the first aspect of the invention, a dispersant may be unevenly distributed in the vicinity of the surfaces of the toner particles, together with fatty acid monoester.

In the liquid developer according to the first aspect of the invention, the content of the dispersant in the liquid developer may be in a range of 0.10 to 3.0 wt %.

In the liquid developer according to the first aspect of the invention, when the content of the dispersant in the liquid developer is A [wt %] and the content of the toner particles is B [wt %], the relationship $0.006 \leqq A/f \leqq 0.12$ may be satisfied.

In the liquid developer according to the first aspect of the invention, the dispersant may be a polymer dispersant.

In the liquid developer according to the first aspect of the invention, viscosity of fatty acid monoester may be 10 mPa·s or less.

In the liquid developer according to the first aspect of the invention, the liquid developer may contain saturated fatty acid ester having the number of carbon atoms ranging from 8 to 18 as fatty acid monoester.

In the liquid developer according to the first aspect of the invention, the liquid developer may contain unsaturated fatty acid ester as fatty acid monoester.

In the liquid developer according to the first aspect of the invention, a resin material forming the toner particles may be polyester resin.

According to a second aspect of the invention, a method of manufacturing a liquid developer includes milling a toner material mainly composed of a resin material in fatty acid monoester to obtain a milled material dispersion liquid, and mixing the milled material dispersion liquid and unsaturated fatty acid triglyceride.

According to a third aspect of the invention, a method of manufacturing a liquid developer includes milling a toner material mainly composed of a resin material in fatty acid monoester, to which a dispersant is added, to obtain a milled material dispersion liquid, and mixing the milled material dispersion liquid and unsaturated fatty acid triglyceride.

In the method according to the third aspect of the invention, the milling may mill the toner material in fatty acid monoester, to which a dispersant is added.

According to a fourth aspect of the invention, a method of manufacturing a liquid developer includes associating fine particles mainly composed of a resin material to obtain associated particles, disintegrating the associated particles in fatty acid monoester to obtain toner particles, and dispersing the resultant toner particles in a liquid containing unsaturated fatty acid triglyceride.

In the method according to the fourth aspect of the invention, upon disintegration, the associated particles may be disintegrated in fatty acid monoester, to which a dispersant is added.

According to a fifth aspect of the invention, an image forming apparatus includes a liquid developer storage unit that stores a liquid developer, a developing unit that develops using the liquid developer supplied from the liquid developer storage unit, a transfer unit that transfers an image formed on the developing unit to a recording medium so as to form a transfer image on the recording medium, and a fixing unit that fixes the transfer image formed on the recording medium onto the recording medium. In the liquid developer, toner particles are dispersed in an insulation liquid, fatty acid monoester is unevenly distributed in the vicinity of surfaces of the toner particles, and the insulation liquid contains unsaturated fatty acid triglyceride.

With this configuration, an environment-friendly liquid developer, in which toner particles have an excellent fixing property onto a recording medium, can be provided. Further, a method of manufacturing a liquid developer that is capable of efficiently manufacturing an environment-friendly liquid developer, in which toner particles have an excellent fixing property onto a recording medium, can be provided. In addition, an image forming apparatus that is capable of forming an environment-friendly toner image having an excellent fixing strength and being suitable for low-temperature and high-speed fixing can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
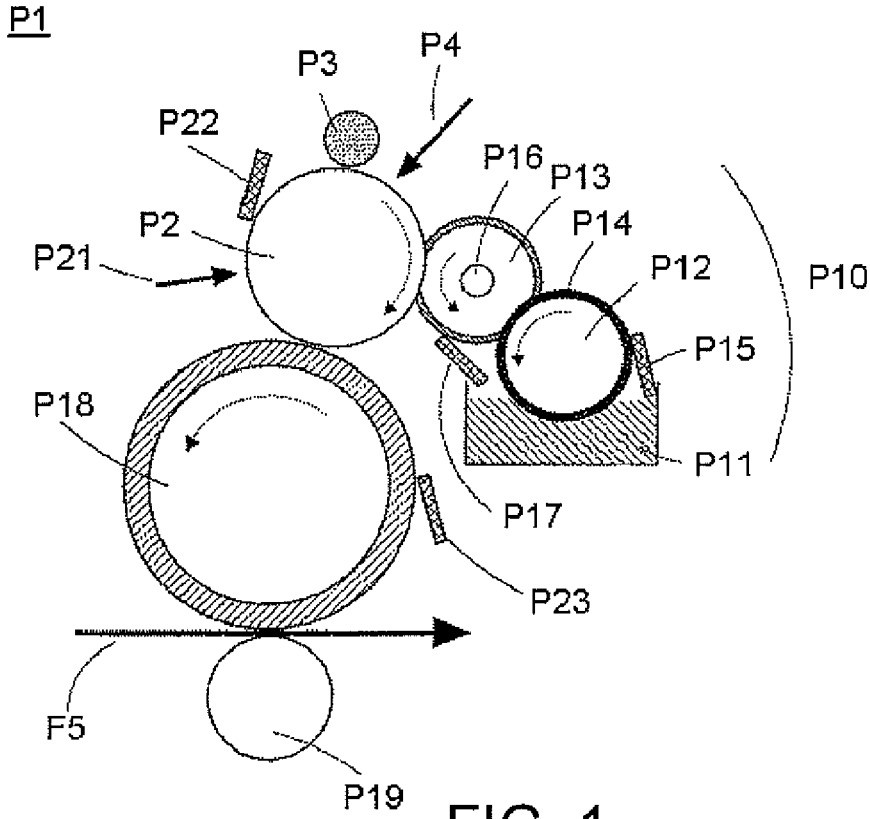
FIG. 1 is a cross-sectional view showing an example of a contact type liquid developing device that constitutes an image forming apparatus according to an embodiment of the invention.

Hereinafter, preferred embodiments of a method of manufacturing a liquid developer, a liquid developer and an image forming apparatus according to the invention will be described in detail.

Liquid Developer

First, a liquid developer according to an embodiment of the invention will be described.

In a liquid developer according to an embodiment of the invention, fatty acid monoester is unevenly distributed in the vicinity of surfaces of toner particles, and the toner particles are dispersed in an insulation liquid that contains unsaturated fatty acid triglyceride.

Insulation Liquid

First, the insulation liquid will be described.

The insulation liquid that is used in the invention contains unsaturated fatty acid triglyceride.

Unsaturated fatty acid triglyceride is plant-derived fatty oil and is environment-friendly. Therefore, leakage of the insulation liquid outside an image forming apparatus, or an affect of the insulation liquid on environment due to the disposal of the used liquid developer can be reduced. As a result, an environment-friendly liquid developer can be provided.

Further, unsaturated fatty acid triglyceride can contribute to improve a fixing property of toner particles onto a recording medium. More specifically, unsaturated fatty acid triglyceride is a component that is cured through oxidization polymerization (subject to oxidization polymerization at a fixing temperature upon fixing) to improve the fixing property of the toner particles.

However, since unsaturated fatty acid triglyceride has low permeability to the recording medium, when an insulation liquid merely containing unsaturated fatty acid triglyceride is used, a sufficient fixing property is rarely obtained.

Accordingly, the inventors have studied and found that the toner particles can be solidly fixed onto the recording medium by using a liquid developer, in which fatty acid monoester is unevenly distributed in the vicinity of the surfaces of the toner particles and the toner particles are dispersed in the insulation liquid containing unsaturated fatty acid triglyceride.

First, fatty acid monoester will be described. Since fatty acid monoester is a component that is likely to permeate the recording medium, fatty acid monoester that is unevenly distributed in the vicinity of the surfaces of the toner particles rapidly permeates the recording medium when the toner particles and the recording medium come into contact with each other upon fixing. Then, when fatty acid monoester permeates, some of the toner particles (a resin material forming the toner particles) molten due to heat upon fixing also permeates the recording medium. Accordingly, an anchor effect is activated, and thus the fixing strength is improved. In addition, when fatty acid monoester permeates, some of unsaturated fatty acid triglyceride in the vicinity of the surfaces of the toner particles also permeates. In this state, oxidization polymerization occurs, and the toner particles are solidly fixed.

When heat or pressure is applied during a fixing process, fatty acid monoester that is unevenly distributed in the vicinity of the surfaces of the toner particles permeates the toner particle (resin material), and plasticizes the toner particles (plasticizer effect). With the plasticizer effect, for example, when a paper is used as the recording medium, the toner particle easily enters a gap between paper fabrics, an anchor effect is effectively present, and a fixing property between the paper and the toner particles is improved. In addition, the liquid developer of the embodiment of the invention contains unsaturated fatty acid triglyceride as the insulation liquid, unsaturated fatty acid triglyceride contained in the insulation liquid is cured by heat or the like upon fixing in a state where the toner particles are contained therein. For this reason, with the anchor effect between the recording medium and the cured liquid developer, an excellent fixing property of the toner particles onto the recording medium can be realized. Further, with the plasticizer effect, since the toner particles can be molten and fixed to the recording medium at a comparatively low temperature, it can also be appropriately applied for image forming at low temperature and high speed.

Further, fatty acid monoester has high compatibility with unsaturated fatty acid triglyceride. Accordingly, like the invention, when the toner particles having unevenly distributed fatty acid monoester in the vicinity of the surfaces thereof are used, dispersibility of the toner particles can be improved. As a result, during storage, sedimentation or aggregation of the toner particles can be effectively prevented. That is, the liquid developer has a high preservation property.

If saturated fatty acid monoester is used, a preservation property of the liquid is superior to a case where unsaturated monoester is used.

Examples of fatty acid monoester that is unevenly distributed on the surfaces of the toner particles include, for example, alkyl(methyl, ethyl, propyl, or butyl)monoester of unsaturated fatty acids, such as oleic acids, palmitoleic acids, linoleic acids, α-linolenic acids, γ-linolenic acids, arachidonic acids, docosahexaenoic acids (DHA), and eicosapentaenoic acids (EPA), and alkyl (methyl, ethyl, propyl, or butyl)monoester of saturated fatty acids, such as butyric acids, carproic acids, caprylic acids, capric acids, lauric acids, mesitylenic acids, palmitic acid, stearic acids, arachic acids, behenic acids, and lignoceric acids, which can be used alone or in combination of two or more of them.

Among the above-described materials, when ester of saturated fatty acid having the number of carbon atoms ranging 8 to 18 is included as fatty acid monoester, fatty acid monoester can be unevenly distributed on the surfaces of the toner particles more reliably.

Among the above-described materials, when unsaturated fatty acid ester is included as fatty acid monoester, upon fixing, unsaturated fatty acid ester is cured together with unsaturated fatty acid triglyceride by heat or the like. Accordingly, the fixing strength of the toner particles onto the recording medium can be made particularly excellent.

When unsaturated fatty acid ester and saturated fatty acid ester having the number of carbon atoms ranging 8 to 18 are used together, the above-described effects of fatty acid monoester can be simultaneously obtained.

Viscosity of fatty acid monoester described above is preferably 10 mPa·s or less, and more preferably, 5 mPa·s or less. Accordingly, fatty acid monoester can further appropriately permeate the recording medium, and the permeation of the toner particles molten by heat upon fixing or unsaturated fatty acid triglyceride to the recording medium can be more reliably promoted. Further, for example, when a liquid developer is manufactured by a method described below, the toner particles having a uniform particle size can be obtained. Further, in this specification, though not particularly limited, viscosity is measured at 25° C. using a vibrating viscometer based on JIS Z8809 (calibration liquid).

Moreover, although a case where fatty acid monoester is unevenly distributed on the surfaces of the toner particle has been described, fatty acid monoester may be included in the toner particles or the insulation liquid. When fatty acid monoester is included in the toner particles, the toner particles can be crushed and extruded upon fixing, and thus the permeation of the molten toner particles to the recording medium can be further effectively promoted. Further, when fatty acid monoester is included in the insulation liquid, viscosity of the insulation liquid can be made appropriate.

Examples of unsaturated fatty acid triglyceride include, for example, univalent unsaturated fatty acid triglycerides, such as oleic acids, palmitoleic acids, and recinoleic acids, and polyvalent unsaturated fatty acid triglycerides, such as linoleic acids, α-linolenic acids, γ-linolenic acids, arachidonic acids, docosahexaenoic acids (DHA), and eicosapentaenoic acids (EPA), which can be used alone or in combination of two or more of them.

Among the above-described materials, polyvalent unsaturated fatty acid triglyceride is preferably used. Further, among the polyvalent unsaturated fatty acid triglyceride, a material having a conjugated unsaturated bind (conjugated unsaturated fatty acid triglyceride) is preferably used. Accordingly, the oxidization polymerization reaction can be further effectively advanced.

As conjugated unsaturated fatty acid triglyceride, any material may be used insofar as it has a conjugated unsaturated bind. For example, a synthetic material or a material directly extracted from plant oil or the like may be used. In addition, a material that is obtained by conjugating unsaturated fatty acid triglyceride may be used.

Among the above-described materials, univalent unsaturated fatty acid triglyceride is cured upon fixing, thereby contributing to improve the fixing strength. In addition, upon preservation, univalent unsaturated fatty acid triglyceride rarely deteriorates due to oxidization or the like, and can reliably prevent a change in viscosity or color of the liquid developer. For this reason, when unsaturated fatty acid triglyceride is used, the liquid developer has excellent fixing strength and long-term preservation property.

Unsaturated fatty acid triglyceride described above is a component that is contained in natural fatty oil, for example, plant oils, such as, castor oil, wood oil, safflower oil, linseed oil, sunflower oil, corn oil, cottonseed oil, rape oil, soybean oil, sesame oil, corn oil, hemp oil, evening primrose oil, blackcurrant oil, borage oil, sardine oil, mackerel oil, and herring oil, and various animal oils.

Among these, since castor oil contains a large amount of conjugated linoleic acid triglyceride (conjugated unsaturated fatty acid triglyceride), it can be suitably used.

Further, among the above-described oils, rape oil, soybean oil, sunflower oil, corn oil, palm oil, and safflower oil contain a large amount oleic acid (univalent unsaturated fatty acid triglyceride) and linoleic acid (polyvalent unsaturated fatty acid triglyceride), and thus they can be suitably used.

In the insulation liquid, the content of unsaturated fatty acid triglyceride is preferably 64 wt % or less, and more preferably, 48 wt % or less. Accordingly, an affect on environment can be particularly reduced, and the oxidization polymerization reaction can be effectively advanced upon fixing.

Further, in the insulation liquid, in addition to the above-described ingredients, for example, saturated fatty acid triglyceride described below may be contained.

Saturated fatty acid triglyceride is a component that has a function of maintaining high chemical stability of the liquid developer. Accordingly, when the insulation liquid contains saturated fatty acid triglyceride, the chemical reaction of the liquid developer can be effectively prevented. As a result, the preservation property and long-term stability of the resultant liquid developer can be further increased.

Further, saturated fatty acid triglyceride has a function of maintaining high electrical insulation. Accordingly, when the insulation liquid contains saturated fatty acid triglyceride, electrical resistance of the liquid developer can be maintained higher.

Examples of saturated fatty acid constituting saturated fatty acid triglyceride include, for example, butyric acid (C4), caproic acid (C6), caprylic acid (C8), capric acid (C10), lauric acid (C12), mesitylenic acid (C14), plamitic acid (C16), stearic acid (C18), arachic acid (C20), behenic acid (C22), and lignoceric acid (C24), which can be used alone or in combination of two or more of them. In the saturated fatty acid, the number of carbon atoms in a molecule is preferably 6 to 22, more preferably, 8 to 20, and still more preferably, 10 to 18. If saturated fatty acid triglyceride composed of such saturated fatty acid is contained, the above-described effects can be markedly exhibited.

The saturated fatty acid triglyceride can be efficiently obtained from natural fatty oils, for example, plant oils, such as palm oil (in particular, palm kernel oil) and coconut oil, and various animal oils (for example, butter).

The insulation liquid may contain ingredients other than the above-described ingredients. Examples of these ingredients include, for example, ISOPAR E, ISOPAR G, ISOPAR H, ISOPAR L (ISOPAR; product name by Exxon Mobil), SHELLSOL 70, SHELLSOL 71 (SHELLSOL; product name by Shell Oil), Amsco OMS, Amsco 460 solvent (Amsco; product name by Spirit Co., Ltd.), mineral oils, such as low-viscosity/high-viscosity liquid paraffin (Wako Pure Chemical Industries Co., Ltd.), resolvents of fatty acid triglyceride, such as glycerine and fatty acid, octane, isooctane, decane, isodecane, decaline, nonane, dodecane, isododecane, cyclohexane, cyclooctane, cyclodecane, benzene, toluene, xylene, and mesitylene, which can be used alone or in combination of two or more of them.

Electrical resistance of the above-described liquid developer at a room temperature (20° C.) is preferably $1\times10^{9}$ Ωcm or more, more preferably, $1\times10^{11}$ Ωcm or more, and still more preferably, $1\times10^{13}$ Ωcm or more.

The dielectric constant of the insulation liquid is preferably 3.5 or less.

Dispersant

The liquid developer preferably contains a dispersant and the dispersant is unevenly distributed in the vicinity of the surfaces of the toner particles. That is, in the liquid developer, most of the dispersant is preferably stuck to molecular chains of resin components at the surfaces of the toner particles.

If the dispersant is dispersed and dissolved in the insulation liquid, when the toner image is to be fixed on the recording medium, the dispersant may interfere with the fixation, and the toner image may not obtain an excellent fixing strength. However, in the liquid developer, if the dispersant is stuck to the surfaces of the toner particles, upon image fixing, it does not interfere with the fixation. As a result, the liquid developer has an excellent fixing property.

The dispersant may be added to the liquid developer to improve dispersibility of the toner particles and to adjust viscosity of the liquid developer. In this case, if the dispersant is added to the liquid developer, electrical resistance of the liquid developer may be lowered due to the dispersant dissolved and dispersed in the insulation liquid, and thus the liquid developer containing the dispersant may not have an excellent charging property. However, if the dispersant is unevenly distributed in the vicinity of the surfaces of the toner particles, the amount of the dispersant dispersed in and released from the insulation liquid can be made small, and thus electrical resistance of the liquid developer can be prevented from being lowered. Further, if the dispersant is stuck to the surfaces of the toner particles, the charging amount of the toner particles can be increased. For this reason, the liquid developer has excellent dispersibility of the toner particles and charging property.

The dispersant is not particularly limited. Examples of the dispersant include, for example, polymer dispersants, such as polyvinyl alcohol, carboxymethyl cellulose, polyethylene glycol, polycarbonate and salts, polyacrylate metal salts (for example, sodium salt), polymethacrylate metal salts (for example, sodium salt), polyglycerine fatty acid ester, polyurethane derivatives, sorbitan fatty acid ester, polyoxyethylene alkyl ether, alkyl ether type nonionic surfactant, sorbitan derivative nonionic surfactants, polymaleate metal salts (for example, sodium salt), acrylate-maleate copolymer metal salts (for example, sodium salt), polystyrene sulfonate metal salts (for example, sodium salt), and polyamine aliphatic polycondensates, viscous mineral, silica, tricalcium phosphate, tristearate metal salts (for example, aluminum salt), distearate metal salts (for example, aluminum salt and barium salt), stearate metal salts (for example, calcium salt, lead salt, and zinc salt), linolenate metal salts (for example, cobalt salt, manganese salt, lead salt, and zinc salt), octanoate metal salts (for example, aluminum salt, calcium salt, and cobalt salt), oleate metal salts (for example, calcium salt and cobalt salt), palmitate metal salts (for example, zinc salt), alkylbenzene sulfonate metal salts (for example, sodium salt), naphthenate metal salts (for example, calcium salt, cobalt salt, manganese salt, lead salt, and zinc salt), resinate metal salts (for example, calcium salt, cobalt salt, manganese lead salt, and zinc salt), which can be used alone or in combination of two or more of them.

Among the dispersants, a polymer dispersant is preferably used, and polyamine aliphatic polycondensate are more preferably used. Since the polymer dispersant can appropriately exist on the surface of the toner particle (can be stuck thereto), it can be unevenly distributed in the vicinity of the surfaces of the toner particle more reliably. Further, the polymer dispersant can allow the fatty acid monoester to be stuck onto the molecules. For this reason, a larger amount of fatty acid monoester can be unevenly distributed in the vicinity of the surfaces of the toner particles. Moreover, as the polyamine aliphatic polycondensate, for example, SOLSPERSE (product name by Lubrizol Japan Ltd.) can be exemplified.

When the polymer dispersant is used, a compound that has a structure having many three-way branch points, from which linear side chains are branched off, on the main chain (comb-like structure) is preferably used as the polymer dispersant. Accordingly, the polymer dispersant has excellent compatibility with the insulation liquid. For this reason, the polymer dispersant having a comb-like structure is solidly stuck to the toner particles, and also has high compatibility with the insulation liquid. As a result, the toner particles have excellent dispersibility in the insulation liquid, and the liquid developer has an excellent preservation property.

The dispersant is preferably a basic dispersant. Accordingly, the dispersant can be appropriately stuck to the associated particles and the toner particles.

The weight-average molecular weight of the polymer dispersant is preferably in a range of 1000 to 100000, and more preferably, 5000 to 80000. Accordingly, the above-described effects can be markedly obtained.

The content of the dispersant in the liquid developer is preferably in a range of 0.10 to 3.0 wt %, more preferably, 0.15 to 1.8 wt %, and still more preferably, 0.20 to 1.5 wt %.

Accordingly, upon preservation, the dispersant can be appropriately unevenly distributed in the vicinity of the surfaces of the toner particles in the liquid developer, and the liquid developer can have an excellent fixing property. Further, the toner particles can have excellent dispersibility, and viscosity of the liquid developer can be appropriately maintained. In addition, the liquid developer can have an excellent charging property. Besides, in a manufacturing method described below, if the dispersant is added with the above-described content, the particle size of the toner particle can be made sufficiently small.

In contrast, if the content of the dispersant is less than the lower limit described above, the amount of the dispersant that is unevenly distributed in the vicinity of the surfaces of the toner particles is lacking depending on the dispersant, and upon preservation, fatty acid monoester cannot be reliably held in the vicinity of the surfaces of the toner particles. Further, the toner particles in the liquid developer may not have excellent dispersibility. Further, viscosity of the liquid developer may be excessively increased depending on the insulation liquid to be used, and thus in a liquid developing device Pi described below, the liquid developer may not be uniformly supplied to a coating roller P12. In addition, in a manufacturing method described below, viscosity upon disintegration or milling may be excessively increased depending on the insulation liquid to be used, and the toner particles each having a sufficiently small particle size may not be obtained. Meanwhile, if the content of the dispersant exceeds the upper limit described above, the amount of the dispersant that cannot be unevenly distributed in the vicinity of the surfaces of the toner particles is increased depending on the dispersant to be used. Accordingly, upon fixing, the dispersant dispersed and dissolved in the insulation liquid may interfere with the fixation of the toner image onto the recording medium. Further, electrical resistance of the liquid developer may be lowered, and thus an excellent charging property cannot be obtained.

Toner Particle

Next, the toner particle will be described.

Constituent Material of Toner Particle

The toner particles (toner) that form the liquid developer of the embodiment of the invention at least contain a resin material.

1. Resin Material

The toner constituting the liquid developer is composed of a material mainly containing a resin material.

In the invention, the resin (binder resin) is not particularly limited. Specific examples of the resin include, for example, styrene-based resins, such as polystyrene, poly-α-methylstyrene, chloropolystyrene, styrene-chlorostyrene copolymer, styrene-proplylene copolymer, styrene-butadiene copolymer, styrene-vinyl chloride copolymer, styrene-vinyl acetate copolymer, styrene-maleate copolymer, styrene-acrylate ester copolymer, styrene-methacrylate ester copolymer, styrene-acrylate ester-methacrylate ester copolymer, styrene-α-chloracrylate methyl copolymer, styrene-acrylonitrile-acrylate ester copolymer, and styrene-vinyl methyl ether copolymer, which are monomers or copolymers containing styrene or styrene substitute, polyester resin, epoxy resin, urethane-modified epoxy resin, silicone-modified epoxy resin, vinyl chloride resin, rosin-modified maleate resin, phenyl resin, polyethylene-based resin, polyproplylene, ionomer resin, polyurethane resin, silicone resin, ketone resin, ethylene-ethyl acrylate copolymer, xylene resin, polyvinyl butyral resin, terpene resin, phenol resin, and aliphatic or cycloaliphatic hydrocarbon resin, which can be used alone or in combination of two or more of them. Among these, when the polyester resin is used, dispersibility of the toner particles in the liquid developer can be superior. Further, since the polyester resin has high transparency, when it is used as the binder resin, a color forming property of an image to be formed can be increased. Further, since the polyester resin has high compatibility with fatty acid monoester, upon preservation, fatty acid monoester that is unevenly distributed on the surfaces of the toner particles can be reliably held in the vicinity of the toner particles. In addition, in a manufacturing method described below, fatty acid monoester can be reliably unevenly distributed on the surfaces of the toner particles. Further, since the dispersant is easily stuck to the polyester resin, the dispersant in the liquid developer can be appropriately stuck to the surfaces of the toner particles. For this reason, the dispersant and fatty acid monoester can be effectively unevenly distributed in the vicinity of the surfaces of the toner particles. As a result, the liquid developer has excellent fixing property and charging property.

While the softening temperature of the resin (resin material) is not particularly limited, it is preferably in a range of 50 to 130° C., more preferably, 50 to 120° C., and still more preferably, 60to 115° C. Moreover, in this specification, the softening temperature indicates a softening start temperature that is defined by measurement conditions of a rate of temperature increase: 5° C./min and a die diameter 1.0 mm in an overhead type flow tester (manufactured by Shimadzu Corporation).

2. Colorant

The toner may contain a colorant. For the colorant, for example, a pigment, a dye, or the like can be used. Examples of the pigment and the dye include, for example, carbon black, spirit black, lamp black (C.I. No. 77266), magnetite, titanium black, chrome yellow, cadmium yellow, mineral fast yellow, navel yellow, naphthol yellow S, Hanza yellow G, permanent yellow NCG, chromium yellow, benzidine yellow, quinoline yellow, tartrazine lake, chrome orange, molybdenum orange, permanent orange GTR, pyrazolone orange, benzidine orange G, cadmium red, permanent red 4R, watching red calcium salt, eosin lake, brilliant carmine 3B, manganese violet, fast violet B, methyl violet lake, iron blue, cobalt blue, alkali blue lake, Victoria blue lake, fast sky blue, indanthrene blue BC, ultramarine blue, aniline blue, phthalocyanine blue, chalco oil blue, chrome green, chromium oxide, pigment green B, malachite green lake, phthalocyanine green, final yellow green G, rhodamine 6G, quinacridone, rose Bengal (C.I. No. 45432), C.I. direct red 1, C.I. direct red 4, C.I. acid red 1, C.I. basic red 1, C.I. mordant red 30, C.I. pigment red 48:1, C.I. pigment red 57:1, C.I. pigment red 122, C.I. pigment red 184, C.I. direct blue 1, C.I. direct blue 2, C.I. acid blue 9, C.I. acid blue 15, C.I. basic blue 3, C.I. basic blue 5, C.I. mordant blue 7, C.I. pigment blue 15:1, C.I. pigment blue 15:3, C.I. pigment blue 5:1, C.I. direct green 6, C.I. basic green 4, C.I. basic green 6, C.I. pigment yellow 17, C.I. pigment yellow 93, C.I. pigment yellow 97, C.I. pigment yellow 12, C.I. pigment yellow 180, C.I. pigment yellow 162, nigrosine dyes (C.I. No. 50415B), metal complex salt dyes, metal oxides, such as silica, aluminum oxide, magnetite, maghemite, various kinds of ferrites, cupric oxide, nickel oxide, zinc oxide, zirconium oxide, titanium oxide, and magnesium oxide, and magnetic materials containing magnetic metals, such as Fe, Co, and Ni, which can be used alone or in combination of two or more of them.

3. Other Ingredients

The toner may contain ingredients other than the above-described ingredients. As these ingredients, for example, a wax, a charging controller, and magnetic powder can be exemplified.

Examples of the wax include, for example, hydrocarbon-based waxes, such as ozocerite, cercine, paraffin wax, microwax, microcrystalline wax, petrolactum, and Fischer Tropsch wax, ester-based waxes, such as carnauba wax, rice wax, methyl laurate, methylmyristae, methyl palmitate, methyl stearate, butyl stearate, candellila wax, cotton wax, Japan wax, bees wax, lanolin, montan wax, and fatty acid ester, olefin-based waxes, such as polyethylene wax, polypropylene wax, oxidized type polyethylene wax, and oxidized type polypropylene wax, amide-based waxes, such as 12-hydroxystearic acid amide, stearic acid amide, and phthalic acid anhydride imide, ketone-based waxes, laurone and stearone, and ether-based waxes, which can be used alone or in combination of two or more of them.

Examples of the charge controller include, for example, metal salts of benzoic acid, metal salts of salicylic acid, metal salts of alkyl salicylic acid, metal salts of catechol, metal-containing bisazo dyes, nigrosine dyes, tetraphenyl borate derivatives, quaternary ammonium salts, aluminum stearate, alkyl pyridinium salts, chlorinated polyesters, nitrofumic acids.

Examples of the magnetic powder include, for example, metal oxides, such as magnetite, maghemite, various kinds of ferrites, cupric oxide, nickel oxide, zinc oxide, zirconium oxide, titanium oxide, and magnesium oxide, and magnetic materials containing magnetic metals, such as Fe, Co, and Ni.

Further, as the constituent materials (ingredient) of the kneaded material, in addition to the above-described materials, for example, zinc stearate, zinc oxide, cerium oxide, silica, titanium oxide, iron oxide, fatty acids, and fatty acid metal salts may be used.

Shape of Toner Particle and the Like

As the toner particles that are applied to the liquid developer of the embodiment of the invention, one having a minute concavo-convex surface is preferably used. With the minute concavo-convexes, the above-described fatty acid monoester can be unevenly distributed (absorbed) in the vicinity of the surfaces of the toner particles more effectively.

The average particle size of the toner particles composed of the above-described materials is preferably in a range of 0.1 to 5 μm, more preferably, 0.1 to 4 μm, and still more preferably, 0.5 to 3 μm. If the average particle size of the toner particles falls within the above-described range, resolution of an image to be formed by the liquid developer (toner) can be sufficiently increased.

An average value (average circularity) of circularity R represented by the following equation (I) relative to the toner particles constituting the liquid developer is preferably in a range of 0.94 to 0.99, and more preferably, 0.96 to 0.99.

$$R=L_0/L_1 \quad (I)$$

(where, in the equation, $L_1$ [μm] represents a peripheral length of a projection image of the toner particles to be measured, and $L_0$ [μm] represents a peripheral length of a circle having the same area as the area of the projection image of the toner particles to be measured)

If the average circularity of the toner particles falls within the above-described range, the insulation liquid can be appropriately included in the toner image of an unfixed toner image transferred onto the recording medium, and the fixing strength of the toner particles can be further increased.

The content of the toner particles in the liquid developer is preferably in a range of 10 to 60 wt %, and more preferably, 20 to 50 wt %. Accordingly, upon preservation, the toner particles can be reliably prevented from coming into contact with each other to release the fatty acid monoester and the dispersant, and the liquid developer can have excellent fixing property and charging property. In addition, the liquid developer can have appropriate viscosity, and the conditions of heating and the like upon fixing can be settled.

Further, when the content of the dispersant in the liquid developer is A [wt %] and the content of the toner particles is B [wt %], the relationship $0.006 \leqq A/B \leqq 0.12$, and more preferably, the relationship $0.01 \leqq A/B \leqq 0.10$ is satisfied. Accordingly, an appropriate amount of the dispersant can be unevenly distributed in the vicinity of the surfaces of the toner particles, and thus the liquid developer can have an excellent fixing property. Further, dispersibility of the toner particles can be particularly increased, and the dispersant dispersed and dissolved in the insulation liquid can be made small. For this reason, the liquid developer can have excellent fixing property and charging property, and can also have appropriate viscosity.

Further, viscosity of the liquid developer is preferably in a range of 20 to 300 mPa·s, and more preferably, 30 to 250 mPa·s. If viscosity of the liquid developer falls within the above-described range, dispersibility of the toner particles can be further increased, and in an image forming apparatus P1, the liquid developer can be further uniformly supplied to a coating roller P12. In addition, the liquid developer can be further effectively prevented from dripping from the coating roller P12 or the like.

Further, electrical resistance of the liquid developer at a room temperature (20° C.) is preferably $1\times10^{9}$ Ωcm or more, more preferably, $1\times10^{11}$ Ωcm or more, and still more preferably, $1\times10^{12}$ Ωcm or more.

Manufacturing Method of Liquid Developer

Next, preferred embodiments of a method of manufacturing a liquid developer according to the invention will be described.

First Embodiment

First, a first embodiment of a method of manufacturing a liquid developer according to the invention will be described.

A method of manufacturing a liquid developer according to this embodiment includes a milling process of milling a toner material mainly composed of a resin material in fatty acid monoester to obtain a milled material dispersion liquid, and a mixing process of mixing the milled material dispersion liquid and a liquid containing unsaturated fatty acid triglyceride.

Pulverizing Process

In this process, the toner material as a kneaded material obtained by kneading the constituent materials of the toner particles with a kneader are wet-milled in fatty acid monoester, to thereby obtain a milled material dispersion liquid.

In this embodiment, in the above-described manner, the toner material is milled in the fatty acid monoester. Accordingly, in the resultant liquid developer, the fatty acid monoester is unevenly distributed (absorbed) in the vicinity of the surfaces of the toner particles. In contrast, when the toner particles are simply dispersed in the fatty acid monoester, the fatty acid monoester cannot be unevenly distributed in the vicinity of the surfaces of the toner particles. That is, with the application of a large shear forcer such as milling, initially, the fatty acid monoester can be unevenly distributed on the surfaces of the toner particles.

Further, since the fatty acid monoester has comparatively low viscosity, a high degree of freedom for motion of the toner material in the fatty acid monoester, and small resistance, a coarsely milled material can be efficiently milled. Further, since the fatty acid monoester has high compatibility with the resin material and comparatively low viscosity, it can enter minute cracks that are generated by milling or the like. As a result, milling can be efficiently performed, and the toner particles each having a small particle size can be efficiently formed. Further, a milling speed can be improved. In addition, if milling is performed in the fatty acid monoester having comparatively low viscosity, energy applied for milling can be efficiently used for milling of the toner material. Therefore, the temperature of the fatty acid monoester can be preventing from increasing. As a result, even though the resin material forming the toner material has a low melting point, milling can be efficiently performed.

Upon disintegration, the fatty acid monoester is stuck to and permeates the surfaces of the associated particles and causes the above-described plasticization effect. A functional group, such as a carboxyl group at the surfaces of the associated particles, which has a hydrophilic property and is ionizable, can be included from the outermost surfaces of the associated particles to the insides of the associated particles that do not come into contact with the hydrophobic insulation liquid. For this reason, the resultant toner particle has excellent dispersibility in the insulation liquid, and electrical resistance of the liquid developer can be increased.

As the toner material used in this process, a coarsely milled material obtained by coarsely milling the kneaded material is preferably used. As such, when the coarsely milled material obtained by coarsely milling the kneaded material is used, in this process, the particle sizes of the toner particles can be effectively made small.

A wet milling method is not particularly limited. For example, milling can be performed using various milling devices and shredding devices, such as a ball mill, a vibrating mill, a jet mill, a pin mill, and the like.

The wet milling process may be performed several times.

In this embodiment, before the fatty acid monoester and the toner material are mixed, the dispersant (surfactant) is preferably added to the fatty acid monoester. Accordingly, the dispersant functions as a milling aid, such that the toner material can be more efficiently milled, and dispersibility of the resultant toner particles can be increased.

If the toner material is milled with the fatty acid monoester, to which the dispersant is added, the dispersant is easily stuck to the surfaces of the toner particles, and the charging property of the resultant liquid developer can be improved. More specifically, upon milling, the fatty acid monoester plasticizes the surfaces of the toner particles, and thus the dispersant is easily stuck to the surfaces of the toner particles. For this reason, the amount of the dispersant dissolved and dispersed in the insulation liquid can be made small, and electrical resistance of the resultant liquid developer can be increased. Further, since the dispersant and the fatty acid monoester are unevenly distributed in the vicinity of the surfaces of the toner particles, the toner particles have excellent dispersibility, and the liquid developer has excellent fixing property and preservation property.

As the dispersant, the constituent material of the above-described liquid developer can be used. Examples of the dispersant include, for example, polyvinyl alcohol, carboxymethyl cellulose, polyethylene glycol, SOLSPERSE (product name by Lubrizol Japan Ltd.), polycarboxylic acid and salts thereof, polyacrylate metal salts (for example, sodium salt), polymethacrylate metal salts (for example, sodium salt), polymaleate metal salts (for example, sodium salt), acrylate-maleate copolymer metal salts (for example, sodium salt), polystyrene sulfonate metal salts (for example, sodium salt), polymer dispersants, such as polyamine aliphatic polycondensates, viscosity mineral, silica, tricalcium phosphate, tristearate metal salts (for example, aluminum salt), distearate acid metal salts (for example, aluminum salt, and barium salt), stearate metal salts (for example, calcium salt, lead salt, and zinc salt), linolenate metal salt(for example, cobalt salt, manganese salt, lead salt, and zinc salt) octanate metal salts (for example, aluminum salt, calcium salt, and cobalt salt), oleate metal salts (for example, calcium salt, cobalt salt), palmitate metal salts (for example, zinc salt) dodecylbenzene sulfonate metal salts (for example, sodium salt), naphthenate metal salts (for example, calcium salt, cobalt salt, manganese salt, lead salt, and zinc salt), resinate metal salts (for example, calcium salt, cobalt salt, manganese lead salt, and zinc salt), etc.

Among the above-described dispersants, when the polymer dispersant is used, milling efficiency can be effectively increased. Further, when milling is performed in the fatty acid monoester, if the polymer dispersant exists, the polymer dispersant can appropriately exist on the surfaces of the toner particle (can be stuck thereto). Accordingly, when it is mixed with a liquid containing unsaturated fatty acid triglyceride described below, the fatty acid monoester can be more effectively held in the vicinity of the surfaces of the toner particles. As a result, dispersibility of the toner particles in the resultant liquid developer can be further improved, and the fixing property can be further increased. In particular, among the polymer dispersants, when a polyamine aliphatic polymer (for example, SOLSPERSE) is used, the above-described effects can be markedly exhibited.

Mixing Process

Next, the resultant milled material dispersion liquid and a liquid containing the above-described unsaturated fatty acid triglyceride are mixed (Mixing Process).

In the above-described manner, the liquid developer according to the embodiment of the invention, in which the fatty acid monoester is unevenly distributed in the vicinity of the surfaces of the toner particles and the toner particles are dispersed in the insulation liquid containing the unsaturated fatty acid triglyceride is obtained.

Second Embodiment

Next, a second embodiment of a method of manufacturing a liquid developer according to the invention will be described.

A method of manufacturing a liquid developer according to this embodiment includes an associated particle forming process of associating fine resin particles mainly composed of the resin material to obtain associated particles, a process of milling the associated particles in fatty acid monoester to obtain toner particle, and a dispersion process of dispersing the obtained toner particles in a liquid containing unsaturated fatty acid triglyceride.

Preparation of Associated Particle

First, an example of a method of preparing associated particles that associates fine resin particles mainly containing a resin material will be described.

For preparation of the associated particles, various methods can be used. In this embodiment, a water-based emulsion in which a dispersoid (fine particles) mainly containing a resin material (toner constituent material) is dispersed in a water-based dispersion medium composed of a water-based liquid is obtained, and the dispersoid in the water-based emulsion is associated, thereby obtaining associated particles.

Water Based Emulsion

First, the water-based emulsion that is used in this embodiment will be described.

In a water-based emulsion that is obtained by a method of preparing a water-based emulsion described below, a dispersoid (fine particles) is finely dispersed in a water-based dispersion medium composed of a water-based liquid.

Water-Based Dispersion Medium (Water-Based Liquid)

A water-based dispersion medium is composed of a water-based liquid.

Herein, the term water-based liquid, means that it is composed water and/or a liquid having excellent compatibility with water (for example, a liquid having solubility of 30 g or more with respect to water 100 g at 25° C.). As such, the water-based liquid contains is composed of water and/or a liquid having excellent compatibility with water, but it is preferably mainly composed of water. In particular, the content of water is preferably 70 wt % or more, and more preferably, 90 wt % or more. If such a water-based liquid is used, for example, dispersibility of the dispersoid in the water-based dispersion medium can be increased, and the dispersoid in the water-based emulsion can have a comparatively small size and have less variation in size. As a result, the resultant toner particle in the liquid developer has less variation in size and shape between particles, and has large circularity.

Further, the water-based dispersion medium (water-based liquid) preferably has low compatibility with a high-insulation liquid described below (for example, solubility of 0.1 g or less with respect to the high-insulation liquid 100 g at 25° C.). Accordingly, the shape of the dispersoid in a mixture described below that is obtained in a mixture preparation process described below can be appropriately maintained, and the shape of the resultant toner particle in the liquid developer can be made uniform.

Specific examples of the water-based liquid include, for example, water, alcohol-based solvents, such as methanol, ethanol, and propanol, ether-based solvents, such as 1,4-dioxane and tetrahydrofuran (THF), aromatic heterocyclic compound-based solvents, such as pyridine, pyrazine, and pyrrole, amide-based solvents, such as N,N-dimethylformamide (DMF) and N,N-dimethylacetamide (DMA), nitrile-based solvents, such as acetonitrile or the like, and aldehyde-based solvents, such as acetaldehyde or the like.

Dispersoid (Fine Particles)

The dispersoid includes ingredients forming the toner particles in the liquid developer.

A solvent that dissolves a part of the ingredients of dispersoid may be added to the dispersoid. Accordingly, for example, flowability of the dispersoid in the water-based emulsion can be increased, and the dispersoid in the water-based emulsion can have a comparatively small size and less variation in size. As a result, the resultant toner particle in the liquid developer has less variation in size and shape, and also has large circularity.

Any solvent may be used insofar as it dissolves at least a part of the constituent ingredients of the dispersoid. Preferably, a solvent having a lower boiling point than the above-described water-based liquid is used. Accordingly, the solvent can be easily removed.

Further, a solvent having low compatibility with the above-described water-based dispersion medium (water-based liquid) (for example, a solvent having solubility of 30 g or less with respect to the water-based dispersion medium 100 g at 25° C.) is preferably used. Accordingly, the dispersoid can be finely dispersed in the water-based emulsion stably.

In addition, the composition of the solvent can be appropriately selected according to, for example, the compositions of the above-described resin and colorant, or the composition of the water-based dispersion medium.

Examples of the solvent include inorganic solvents, such as carbon disulfide and carbon tetrachloride, or organic solvents, for example, ketone-based solvents, such as methyl ethyl ketone (MEK), acetone, diethyl ketone, methyl isobutyl ketone (MIBK), methyl isopropyl ketone (MIPK), cyclohexanone, 3-heptanone, and 4-heptanone, alcohol-based solvent, such as methanol, ethanol, n-propanol, isopropanol, n-butanol, i-butanol, t-butanol, 3-methyl-1-butanol, 1-pentanol, 2-pentanol, n-hexanol, cyclohexanol, 1-heptanol, 1-octanol, 2-octanol, 2-methoxyethanol, allylalcohol, furfuryl alcohol, and phenol, ether-based solvents, such as diethyl ether, dipropyl ether, diisopropyl ether, dibutyl ether, 1,2-dimethoxyethane (DME), 1,4-dioxane, tetrahydrofuran (THF), tetrahydropyran (THP), anisole, diethylene glycol dimethyl ether (diglyme), and 2-methoxyethanol, cellosolve-based solvents, such as methyl cellosolve, ethyl cellosolve, and phenyl cellosolve, aliphatic hydrocarbon-based solvents, such as hexane, pentane, heptane, cyclohexane, methyl cyclohexane, octane, didecane, methylcyclohexene, and isoprene, aromatic hydrocarbon-based solvents, such as toluene, xylene, benzene, ethylbenzene, and naphthalene, aromatic heterocyclic compound-based solvents, such as pyridine, pyrazine, furan, pyrrole, thiophene, 2-methyl pyridine, 3-methyl pyridine, 4-methyl pyridine, and furfuryl alcohol, amide-based solvents, such as N,N-dimethylformamide (DMF) and N,N-dimethylacetamide (DMA), halogenated compound-based solvents, such as dichloromethane, chloroform, 1,2-dichloroethane, trichloroethylene, and chlorobenzene, ester-based solvents, such as acetylacetone, ethyl acetate, methyl acetate, isopropyl acetate, isobutyl acetate, isopentylacetate, ethyl chloroacetate, butyl chloroacetate, isobutyl chloroacetate, ethyl formate, isobutyl formate, ethyl acrylate, methyl methacrylate, and ethyl benzonate, amine-based solvents, such as trimethyl amine, hexyl amine, triethyl amine, and aniline, nitrile-based solvents, such as acrylonitrile, acetonitrile, nitro-based solvents, such as nitromethane and nitroethane, and aldehyde-based solvents, such as acetoaldehyde, propione aldehyde, butyl aldehyde, pentanal, and acrylaldehyde. One from the solvents or two or more of them in admixture can be used.

The water-based emulsion may contain an emulsified dispersant.

When the emulsified dispersant is used, dispersibility of the dispersoid can be improved, and the shape and the variation in size of the dispersoid in the water-based emulsion can be comparatively easily made considerably small. In addition, the shape of the dispersoid can have substantially a spherical shape. As a result, the resultant liquid developer that is composed of the toner particles having substantially a spherical shape and the uniform shape and size can be obtained. Here, for the emulsified dispersant, for example, emulsifiers, dispersants, and dispersion aids may be exemplified.

Examples of the dispersant include, for example, inorganic dispersants, such as clay minerals, silica, and tricalcium phosphate, nonionic organic dispersants, such as polyvinyl alcohol, carboxymethyl cellulose, polyethylene glycol, and hydroxy stearic acid ester, anionic organic dispersants, such as tristearate metal salts (for example, aluminum salt), distearate metal salts (for example, aluminum salt and barium salt), stearate metal salt (for example, calcium salt, lead salt, and zinc salt), linolenate metal salts (for example, cobalt salt, manganese salt, lead salt, and zinc salt), octanate metal salts (for example, aluminum salt, calcium salt, and cobalt salt), oleate metal salts (for example, calcium salt and cobalt salt), palmitate metal salts (for example, zinc salt), naphthenate metal salts (for example, calcium salt, cobalt salt, manganese salt, lead salt, and zinc salt), resinate metal salts (for example, calcium salt, cobalt salt, manganese lead salt, and zinc salt), polyacrylate metal salts (for example, sodium salt), polymethacrylate metal salts (for example, sodium salt), polymaleate metal salts (for example, sodium salt), acrylate-maleate copolymer metal salts (for example, sodium salt), and polystyrene sulfonate metal salts (for example, sodium salt), and cationic organic dispersant, such as quaternary ammonium salt. Among these, the nonionic organic dispersant or the anionic organic dispersant is preferably used.

While the content of the dispersant in the water-based emulsion is not particularly limited, it is preferably 3.0 wt %or less, and more particular, in a range of 0.01 to 1.0 wt %.

For the dispersion aid, for example, anionic, cationic, and nonionic surfactants can be exemplified.

The dispersion aid may also be used as the dispersant. When the water-based emulsion contains the dispersant, the content of the dispersion aid in the water-based emulsion is not particularly limited, but it is preferably 2.0 wt % or less, and more preferably, in a range of 0.005 to 0.5 wt %.

Other ingredients than the dispersoid may be dispersed as an insoluble component in the water-based emulsion. For example, fine inorganic powder, such as silica, titanium oxide, and iron oxide, and fine organic powder, such as fatty acid and fatty acid metal salt may be dispersed in the water-based emulsion.

In the above-described water-based emulsion that is used in the invention, since dispersoid is liquid, the dispersoid tends to become a shape having large circularity (sphericity) by surface tension. Accordingly, in the resultant toner particle for liquid development, circularity is considerably high, and a variation in shape between the particles becomes considerably small.

While the content of the dispersoid in the water-based emulsion is not particularly limited, it is preferably in a range of 5 to 55 wt %, and more preferably, 10 to 50 wt %. Accordingly, coupling (aggregation) of the dispersoids in the water-based emulsion can be reliably prevented, and superior productivity of the toner particles (liquid developer) can be achieved.

While the average particle size of the dispersoid (liquid dispersoid) in the water-based emulsion is not particularly limited, it is preferably in a range of 0.01 to 3 μm, and more preferably, 0.1 to 2 μm. Accordingly, the result toner particle having an appropriate size can be obtained. Moreover, in this specification, the term average particle size, means an average particle size based on the volume.

Water-Based Emulsion Preparation Process

The above-described water-based emulsion can be prepared, for example, in the following manner (water-based emulsion preparation process).

First, an aqueous solution in which, as occasion demands, a dispersant is added to the above-described water-based liquid is prepared.

Meanwhile, a resin solution containing a resin or its precursor (hereinafter, collectively referred to as 'resin material') as the main ingredient of the toner described above is prepared. In the preparation of the resin liquid, for example, the solvent described above may be used in addition to the resin material. Further, the resin liquid may be a molten liquid that is obtained by heating the resin material. In addition, in the preparation of the resin liquid, for example, a kneaded material that is obtained by kneading the materials for the toner, such as the resin material, the colorant, and the like may be used. If such a kneaded material is used, even though the constituent materials of the toner include ingredients that are rarely dispersed or compatible with each other, the individual ingredients in the resultant kneaded material can be sufficiently compatible with each other and finely dispersed through kneading. In particular, when a pigment (colorant) having a comparatively low dispersibility with respect to the above-described solvent is used, if kneading is performed in advance before the solvent is dispersed, the resin component and the like effectively coats around the pigment particles. Accordingly, dispersibility of the pigment in the solvent is improved (in particular, fine dispersion in the solvent is possible), and a good color forming property of the resultant toner is obtained. From this viewpoint, even though the constituent materials of the toner include components having low dispersibility with respect to the water-based dispersion medium of the above-described water-based emulsion or components having low solubility with respect to the solvent contained in the dispersion medium of the water-based emulsion, the dispersoid having excellent dispersibility in the water-based emulsion can be obtained.

Next, the resin liquid is gradually dropped and added to the aqueous solution in a stirred state, and then a water-based emulsion in which the dispersoid containing the resin material is dispersed in the water-based dispersion medium is obtained. By preparing the water-based emulsion in such a manner, circularity of the dispersoid in the water-based emulsion can be further increased. As a result, the resultant toner particles for liquid development have high circularity and less variation in shape between the particles. When the resin liquid is dropped, the aqueous solution and/or the resin liquid may also be heated. Further, when the solvent is used in the preparation of the resin liquid, for example, at least a portion of the solvent contained in the dispersoid may be removed by heating the resultant water-based emulsion or placing the same under a reduced pressure atmosphere after the resin liquid is dropped.

As for the mixture of the resin liquid and the water-based liquid, a phase inversion emulsification may be performed by gradually adding (dropping) the water-based liquid to the colored resin liquid while applying a shear force to the resin liquid using a stirrer, and finally, a dispersion liquid in which a resin liquid-derived dispersoid is dispersed in the water-based liquid may be obtained. Accordingly, for example, a water-based emulsion in which the dispersoid is homogeneously and finely dispersed can be easily and reliably obtained.

Associated Particle Forming Process

Next, an electrolyte is added to the water-based emulsion obtained in the above-described manner, and the dispersoid is associated so as to form associated particles (associated particle forming process).

Examples of the additive electrolyte include, for example, acidic materials, such as hydrochloric acid, sulfuric acid, phosphoric acid, acetate, and oxalic acid, and organic and inorganic water-soluble salts, such as sodium sulfate, ammonium sulfate, potassium sulfate, magnesium sulfate, sodium phosphate, sodium dihydrogenphosphate, sodium chloride, potassium chloride, ammonium chloride, calcium chloride, and sodium acetate, which can be used alone or in combination of two or more of them. Among these, univalent cationic sulfate salts, such as sodium sulfate and ammonium sulfate, can be appropriately used for uniform association.

Moreover, before the electrolyte and the like are added, an inorganic dispersion stabilizer, such as hydroxy apatite, or an ionic or nonionic surfactant can be used as the dispersion stabilizer. When the dispersion stabilizer (emulsifier) is used, if the electrolyte is added, ununiform association can be prevented.

Examples of the dispersion stabilizer include, for example, nonionic surfactants, such as polyoxyethylene nonylphenyl ether, polyoxyethylene octylphenyl ether, polyoxyethylene dodecylphenyl ether, polyoxyethylene alkyl ether, polyoxyethylene fatty acid ester, sorbitan fatty acid ester, polyoxyethylene sorbitan fatty acid ester, and various kinds of PLURONIC, alkyl sulfate ester salt type anionic surfactants, and quaternary ammonium salt type cationic surfactants. Among these, the anionic or nonionic surfactant is effective for dispersion stability even with a small additive amount. The cloud point of the nonionic surfactant that can be appropriately used is preferably 40° C. or more.

The additive amount of the electrolyte is preferably in a range of 0.5 to 15 parts by weight with respect to 100 parts by weight of the solid content in the water-based emulsion, more preferably, 1 to 12 parts by weight, and still more preferably, 1 to 10 parts by weight. If the additive amount of the electrolyte is less than the lower limit described above, association of the dispersoid may not sufficiently progress. Further, if the additive amount of the electrolyte exceeds the upper limit described above, association of the dispersoid may become ununiform, and coarse particles may be generated. Then, a variation in size between the resultant toner particles may occur.

Further, this process may be performed immediately after the water-based emulsion is prepared, or may be performed after the water-based emulsion is prepared and preserved. In the latter case, the preservation period is not particularly limited. If the preservation is within ten days, the particle size distribution of the resultant associated particles can be made narrow.

Next, after association, filtering, cleaning, and drying are performed, thereby obtaining the associated particles.

The average particle size of the resultant associated particles is preferably in a range of 0.1 to 7 μm, and more preferably, 0.5 to 3 μm. Accordingly, the particle size of the resultant toner particles can be made appropriately.

Disintegration Process

Next, the associated particles obtained in the above-described manner are disintegrated in fatty acid monoester (disintegration process). Accordingly, a toner particle dispersion liquid in which the toner particles are dispersed in fatty acid monoester is obtained.

As such, when the associated particles are disintegrated in fatty acid monoester, in the resultant liquid developer, fatty acid monoester is unevenly distributed (absorbed) in the vicinity of the surfaces of the toner particles. That is, by applying a large shear force through the disintegration, fatty acid monoester can be unevenly distributed on the surfaces of the toner particles.

Since the disintegration is performed in the liquid, such as fatty acid monoester, the occurrence of coarse toner particles due to aggregation can be prevented.

The resultant toner particles have concavo-convex surfaces due to the fine particles (dispersoid), fatty acid monoester can be reliably held-in the concavo-convexes.

Further, in this embodiment, since the toner particles are obtained by disintegrating the associated particles, fine powder (particles each having an extremely smaller size than the particles each having a target size) can be effectively prevented from occurring, compared with a known milling method or a wet milling method. As a result, the charging property of the resultant liquid developer and the like can be effectively prevented from being degraded due to fine powder.

Since the fatty acid monoester has comparatively low viscosity, it easily enters between the fine particles (dispersoid) forming the associated particles, and thus the associated particles can be suitably disintegrated.

Upon disintegration, the fatty acid monoester is stuck to and permeates the surfaces of the associated particles to cause the above-described plasticization effect, thereby plasticizing the surfaces of the associated particles. Further, the surfaces of the associated particles are plasticized upon disintegration. Accordingly, a functional group, such as a carboxyl group at the surfaces of the associated particles, which has a hydrophilic property and is ionizable, can be included from the outermost surfaces of the associated particles to the insides of the associated particles that do not come into contact with hydrophobic the insulation liquid. For this reason, the toner particle has excellent dispersibility in the insulation liquid, and electrical resistance of the liquid developer can be increased.

In this embodiment, preferably, upon disintegration, the dispersant is added to the fatty acid monoester, and then the disintegration of the associated particles is performed. As such, if the dispersant is added upon disintegration, the dispersant can be suitably unevenly distributed in the vicinity of the surfaces of the toner particles. Further, since the fatty acid monoester stuck to the surfaces of the toner particles plasticizes the surfaces of the toner particles, the dispersant is easily stuck to the toner particles, and the stuck dispersant is solidly held on the surfaces the toner particles after the disintegration. As a result, after the disintegration, even though it is mixed with a liquid containing a different insulation liquid, the dispersant can be further reliably held in the vicinity of the surfaces of the toner particles. Further, upon preservation, the dispersant in the vicinity of the surfaces of the toner particles is reliably held in the vicinity of the surfaces of the toner particles. As a result, the liquid developer has excellent preservation property, charging property, and fixing property.

During the disintegration, the dispersant is stuck to the surfaces of the associated particles, dispersibility of the associated particles is increased, and viscosity of the mixture of the associated particles and the insulation liquid is reduced. For this reason, the associated particles more efficiently disintegrated. Further, since the disintegration is performed with the dispersant, even when the surface area of the associated particle is increased due to the disintegration, viscosity of the liquid developer can be maintained in an appropriate range.

The dispersant that can be used for the disintegration is not particularly limited. For example, the dispersant as the constituent material of the above-described liquid developer may be used.

Among the dispersants, the polymer dispersant is preferably used. More preferably, a polyamine aliphatic polycondensate is used. When the polymer dispersant is used, a polymer dispersant can appropriately exist on the surfaces of the toner particles (can be stuck thereto). For this reason, the polymer dispersant can be reliably unevenly distributed in the vicinity of the surfaces of the toner particles. As a result, the above-described effects can be more reliably obtained.

An apparatus that is used for the disintegration is not particularly limited. For example, a ball mill, such as vibrating ball mill, a rotating ball mill, or a planetary ball mill, a cutting mill, such as a universal cutting mill, a rotor speed mill, a bead mill, such as a vertical bead mill, a horizontal bead mill, an attritor, an SC mill, an MSC mill, or a fine mill, a jet mill, a classifier mill, a disk mill, an impact coal pulverizer, or an automatic mortar can be used. Among these, the bead mill or the ball mill is preferably used. With this apparatus, the associated particles can be disintegrated with an appropriate shear force, and thus the toner particles having a narrow particle size distribution and each having a sufficiently small size can be efficiently obtained. Further, the fatty acid monoester and the dispersant can be appropriately stuck to the surfaces of the toner particles and can be unevenly distributed. For this reason, in the resultant liquid developer, the toner particles that have a narrow particle size distribution and have a small particle size are stably dispersed. As a result, excellent charging property and fixing property are realized.

Dispersion Process

Next, the toner particle dispersion liquid obtained as described above and the liquid containing unsaturated fatty acid triglyceride are mixed, and the toner particles are dispersed in the insulation liquid (Dispersion Process).

In the above-described manner, the liquid developer according to the embodiment of the invention, in which the fatty acid monoester and the dispersant are unevenly distributed in the vicinity of the surfaces of the toner particles and the toner particles are dispersed in the insulation liquid containing unsaturated fatty acid triglyceride, is obtained.

Next, a preferred embodiment of an image forming apparatus according to the invention, to which the above-described liquid developer is applied, will be described. An image forming apparatus according to the embodiment of the invention includes a liquid developing device that forms a toner image on the recording medium, and a fixing device that fixes the formed toner image to the recording medium.

FIG. 1 shows an example of a contact type liquid developing device that constitutes the image forming apparatus according to an embodiment of the invention. The liquid developing device P1 has a developer container (liquid developer storage unit) P11 that stores a liquid developer, a cylindrical photoreceptor (developing unit) P2 that develops an image (toner image), a developing unit P10 that supplies the liquid developer from the developer container P11 to the photoreceptor P2, and an intermediate transfer roller (transfer unit) P18 that transfers the image developed on the recording medium by the photoreceptor P2 so as to form a transfer image (toner image).

The liquid developing device P1 has a drum of the cylindrical photoreceptor P2. The surface of the drum is uniformly charged by a charger P3 formed of epichlorohydrin rubber or the like, and then exposure P4 is performed thereon by a laser diode or the like according to information to be recorded, thereby forming an electrostatic latent image.

The developing unit P10 has a coating roller P12, a portion of which is immersed into the developer container P11, and a developing roller P13. The coating roller P12 is, for example, a gravure roller formed of a metal, such as stainless steel, and rotates while facing the developing roller P13. Further, a liquid developer coated layer P14 is formed on the surface of the coating roller P12, and the thickness thereof is maintained constant by a metering blade P15.

Then, the liquid developer is transferred from the coating roller P12 to the developing roller P13. The developing roller P13 has a roller core member P15 formed of a metal, such as stainless steel, and a low-hardness silicone rubber layer provided on the roller core member P16. On the surface of the silicone rubber layer, a resin layer formed of conductive PFA (polytetrafluoroethylene-perfluorovinyl ether copolymer) is formed. The developing roller P13 is adapted to rotate at the same speed as the photoreceptor P2 to transfer the liquid developer to a latent image section. A part of the liquid developer remaining on the developing roller P13 after the transfer to the photoreceptor P2 is removed by a developing roller cleaning blade P17 and then collected in the developer container P11.

After the image (toner image) is transferred from the photoreceptor to the intermediate transfer roller, the photoreceptor is discharged with discharging light P21, and a toner that has not been transferred and remains on the photoreceptor is removed by a cleaning blade P22 formed of urethane rubber or the like.

In a similar manner, the toner that is not transferred and remains on the intermediate transfer roller P18 after the toner image has been transferred to a recording medium F5, such as a paper from the intermediate transfer roller P18, is removed by a cleaning blade P23 formed of urethane rubber or the like.

The image (toner image) formed on the photoreceptor P2 is transferred to the intermediate transfer roller P18. Then, a transfer current is supplied to a secondary transfer roller P19, and the toner image transferred on the intermediate roller P18 is transferred onto the recording medium F5 that passes between the intermediate transfer roller P18 and the secondary transfer roller P19. Thereafter, the toner image (transfer image) on the recording medium F5 is fixed thereto using a fixing unit described below.

Figure 2:
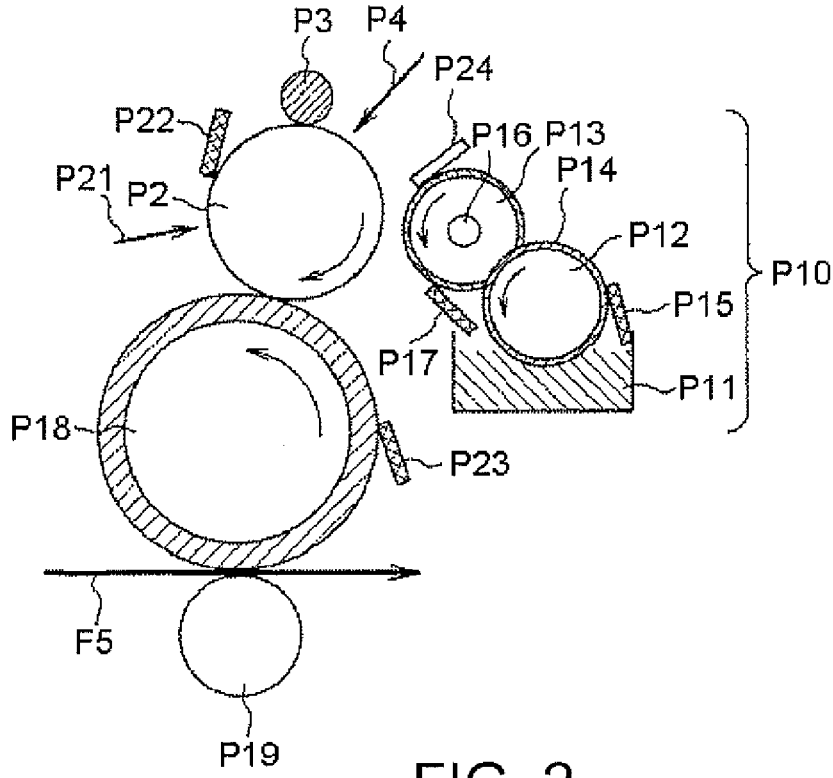
FIG. 2 is a cross-sectional view showing an example of a non-contact type liquid developing device that constitutes an image forming apparatus according to an embodiment of the invention.

FIG. 2 shows an example of a non-contact type liquid developing device that constitutes an image forming apparatus according to the embodiment of the invention. In the non-contact type, a developing roller P13 is provided with a charging blade P24 that is formed of a phosphor-bronze plate having a thickness of 0.5 mm. The charging blade P24 has a function of causing a layer of the liquid developer to be frictionally charged. Further, since the coating roller P12 is a gravure roller, a layer of a developer having concavo-convexes that correspond to concavo-convexes on the surface of the gravure roller is formed on the developing roller P13. The charging blade 24 also has a function of uniformizing the concavo-convexes formed on the developing roller P13. The orientation of the charging blade 24 is either of a counter direction or a trail direction with respect to the rotation direction of the developing roller. Further, the charging blade 24 may be in a form of a roller not a blade.

Preferably, between the developing roller P13 and the photoreceptor P2, there is formed a gap whose width is 200 μm to 800 μm, and an AC voltage having 500 to 3000 Vpp and a frequency of 50 to 3000 Hz which is superimposed on a DC voltage of 200 to 800 V is applied across the developing roller P13 and the photoreceptor P2. Other parts are the same as those of the liquid developing device described with reference to FIG. 1.

Moreover, the description has been made with respect to image formation by the embodiments shown in FIGS. 1 and 2 in which the liquid developer of one color is used. However, it goes without saying that, when an image is formed using color toners of a plurality of colors, a color image can be formed using a plurality of developing units corresponding to the respective colors to form images of the respective colors.

Figure 3:
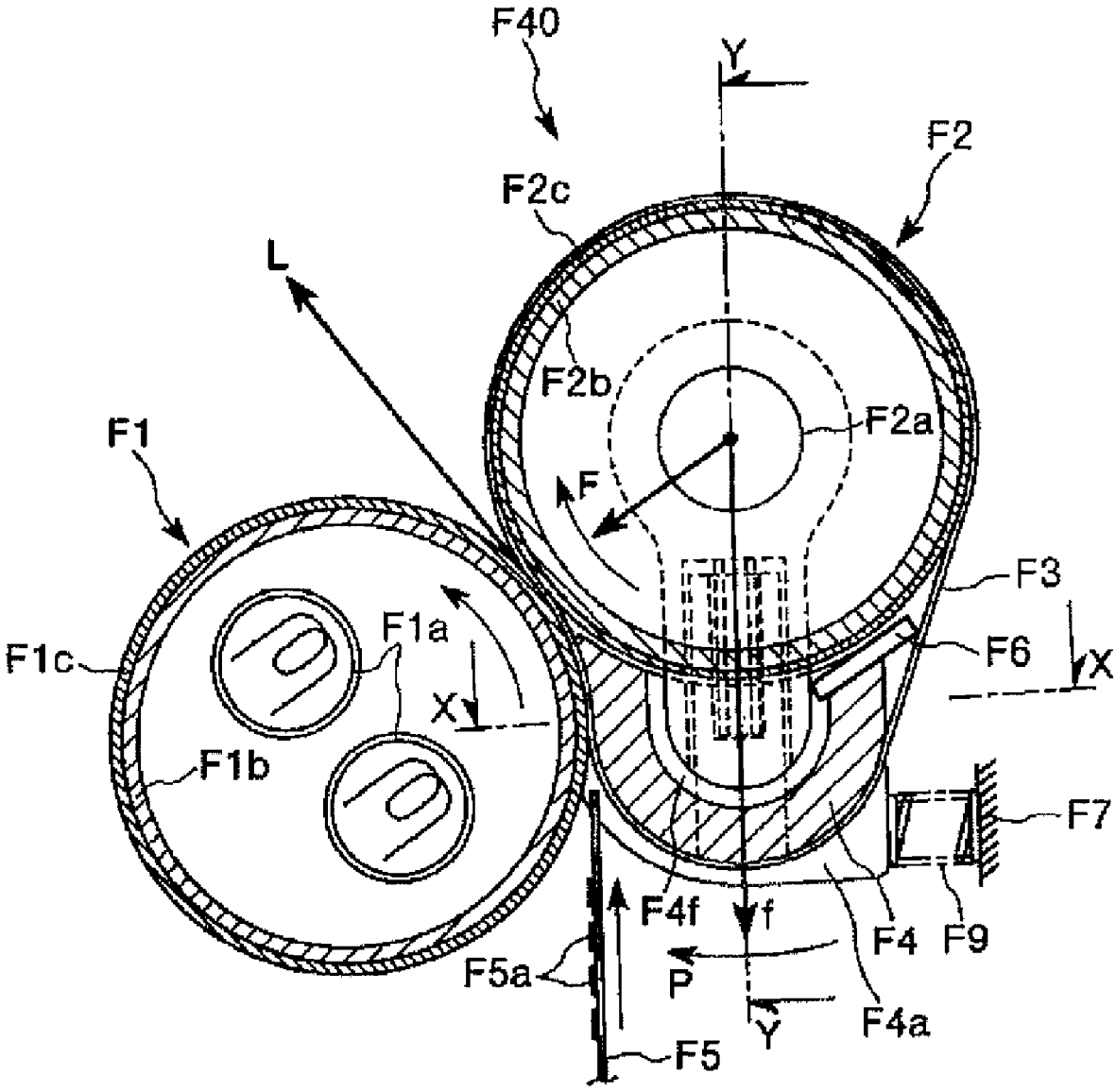
FIG. 3 is a cross-sectional view showing an example of a fixing device that constitutes an image forming apparatus according to an embodiment of the invention.

FIG. 3 is a cross-sectional view showing an example of a fixing device that constitutes the image forming apparatus according to the embodiment of the invention.

As shown in FIG. 3, a fixing device (fixing unit) F40 has a heat fixing roller F1, a pressure roller F2, a heat resistant belt F3, a belt tension member F4, a cleaning member F6, a frame F7, and a spring F9.

The heat fixing roller (fixing roller) F1 has a roller base F1*b* that is formed of a pipe member, an elastic body F1*c* that covers the periphery of the roller base F1*b*, and a tubular halogen lamp F1*a* that is provided in the roller base F1*b* to function as a heat source. The heat fixing roller F1 is rotatable in a counterclockwise direction as indicated by an arrow in the drawing The pressure roller F2 has a roller base F2*b* that is formed of a pipe member, and an elastic body F2*c* that covers the periphery of the roller base F2*b*. The pressure roller F2 is rotatable in a clockwise direction as indicated by an arrow in the drawing.

A PFA layer is provided on the surface layer of the elastic body F1*c* of the heat fixing roller F1. Accordingly, even though the thicknesses of the elastic bodies F1*c* and F2*c* are different from each other, both elastic bodies F1*c* and F2*c* are elastically deformed substantially uniformly, thereby forming a so-called horizontal nip. Further, there is no difference between the peripheral velocity of the heat fixing roller F1 and the feed speed of the heat resistant belt F3 or the recording medium F5 described below. For this reason, it is possible to perform extremely stable image fixation.

Further, two tubular halogen lamps F1*a* and F1*a* that form the heat source are provided inside the heat fixing roller F1. The tubular halogen lamps F1*a* and F1*a* are provided with heating elements, respectively, which are arranged at different positions. With this arrangement, by selectively lighting up any one or both of the halogen lamps F1*a* and F1*a*, it is possible to easily perform a temperature control under different conditions, such as a case where a wide recording medium is used or a narrow recording medium is used, or a case where a fixing nip portion where the heat resistant belt F3 described below winds around the heat fixing roller F1 is to be heated or a portion where the belt tension member F4 described below slidably comes into contact with the heat fixing roller F1 is to be heated.

The pressure roller F2 is disposed to face the heat fixing roller F1, and is adapted to apply a pressure to the recording medium F5, on which an unfixed toner image is formed, through the heat resistant belt F3 described below. With the application of the pressure, the insulation liquid can efficiently enter the recording medium F5. As a result, the unsaturated fatty acid component in the insulation liquid can be more reliably cured in the recording medium F5 by heat and ultraviolet irradiation described below. Further, with the anchor effect, the toner image F5*a* can be further solidly fixed onto the recording medium F5.

The pressure roller F2 has the roller base F2*b* that is formed of a pipe member, and the elastic body F2*c* that covers the periphery of the roller base F2*b*. The pressure roller F2 is rotatable in a clockwise direction as indicated by an arrow in the drawing.

The elastic body F1*c* of the heat fixing roller F1 and the elastic body F2*c* of the pressure roller F2 are elastically deformed substantially uniformly, thereby forming a so-called horizontal nip. Further, there is no difference between the peripheral velocity of the heat fixing roller F1 and the feed speed of the heat resistant belt F3 described below or the recording medium F5. For this reason, it is possible to perform extremely stable image fixation.

The heat resistant belt F3 is a ring-shaped endless belt, and it winds around the peripheries of the pressure roller F2 and the belt tension member F4 such that it can be moved with being held between the heat fixing roller F1 and the pressure roller F2 in a pressed state.

The heat resistant belt F3 is formed of a seamless tube having a thickness of 0.03 mm or more. Further, the seamless tube has a two-layered structure in which its surface (a surface that comes into contact with the recording medium F5) is formed of PFA, and the opposite surface thereof (a surface that comes into contact with the pressure roller F2 and the belt tension member F4) is formed of polyimide. Moreover, the heat resistant belt F3 is not limited thereto, but it may be formed of other materials. Examples of the tubes formed of other materials include a metal tube, such as a stainless tube or a nickel electrocasting tube, a heat-resistance resin tube, such as a silicone tube, and the like.

The belt tension member F4 is disposed on an upstream side of the fixing nip portion between the heat fixing roller F1 and the pressure roller F2 in the feed direction of the recording medium F5. Further, the belt tension member F4 is pivotally disposed about a rotation shaft F2*a* of the pressure roller F2 in the direction of an arrow P.

The belt tension member F4 is configured such that the heat resistant belt F3 is extended with tension in the tangential direction of the heat fixing roller F1 in a state where the recording medium F5 does not pass through the fixing nip portion. When the fixing pressure is large at an initial position where the recording medium F5 enters the fixing nip portion, there may be a case where the recording medium F5 cannot enter the fixing nip portion smoothly and thus fixing is performed in a state where the tip portion of the recording medium F5 is folded. However, in this embodiment, the belt tension member F4 is provided such that the heat resistant belt F3 is extended with tension in the tangential direction of the heat fixing roller F1. Accordingly, it is possible to form an introduction portion for smoothly introducing the recording medium F5, such that the recording medium F5 can be introduced into the fixing nip portion in a stable manner.

The belt tension member F4 is a roughly semicircular belt sliding member that is fitted into the inside of the heat resistant belt F3 so as to apply tension f to the heat resistant belt F3 in cooperation with the pressure roller F2 (the heat resistant belt F3 slidably moves on the belt tension member F4). The belt tension member F4 is disposed at a position where a nip portion is formed by pressing a portion of the heat resistant belt F3 toward the heat fixing roller F1 over the pressure roller F2 over a tangential line L on the pressing portion where the heat fixing roller F1 is pressed against the pressure roller F2. A protruding wall F4*a* is formed on one end or both ends of the belt tension member F4 in the axial direction. The protruding wall F4*a* is provided to restrict the heat resistant belt F3 from being deviated off to the side by coming into contact therewith when the heat resistant belt F3 is deviated in any one side of the axial ends. The spring F9 is provided between an end of the protruding wall F4*a* opposite to the heat fixing roller F1 and the frame, thereby slightly pressing the protruding wall F4*a* of the belt tension member F4 against the heat fixing roller F1. In such a manner, the belt tension member F4 is positioned with respect to the heat fixing roller F1 while slidably coming into contact with the heat fixing roller F1.

A position where the belt tension member F4 is slightly pressed against the heat fixing roller F1 becomes a nip initial position, and a position where the pressure roller F2 is pressed against the heat fixing roller F1 becomes a nip end position.

A linear pressure against the recording medium F5 at the nip end position, that is, a linear pressure of the pressure roller F2 against the recording medium F5 is preferably 500 g/cm or less, and more preferably, 300 g/cm or less. As such, even though a comparatively low linear pressure is applied, when the above-described liquid developer is applied, the toner particles can be solidly fixed onto the recording medium F5. Further, since a comparatively low linear pressure is used, driving power of the pressure roller F2 or the heat fixing roller F1 can be made small, and thus energy saving can be realized.

In the fixing device F40, the recording medium F5, on which an unfixed toner image F5*a* is formed using an image forming apparatus described below, enters the fixing nip portion from the nip initial position, passes between the heat resistant belt F3 and the heat fixing roller F1, and gets off from the nip end position. Then, the unfixed toner image F5*a* formed on the recording medium F5 is thermally fixed, and thereafter, the recording medium F5 is discharged in the tangential direction L of the pressing portion of the pressure roller F2 against the heat fixing roller F1.

The cleaning member F6 is disposed between the pressure roller F2 and the belt tension member F4.

The cleaning member F6 slidably comes into contact with the inner surface of the heat resistant belt F3 so as to clean foreign substances or wear debris on the inner surface of the heat resistant belt F3. Since the foreign substances or wear debris is cleaned in such a manner, the heat resistant belt F3 is refreshed, and the unstable factors on the frictional coefficients are eliminated. Further, the belt tension member F4 is provided with a concave portion F4*f*, in which the foreign substances or wear debris removed from the heat resistant belt F3 is collected.

Moreover, in order to stably drive the heat resistant belt F3 by the pressure roller F2 in a state where the heat resistant belt F3 winds around the pressure roller F2 and the belt tension member F4, the frictional coefficient between the pressure roller F2 and the heat resistant belt F3 is set to be larger than the frictional coefficient between the belt tension member F4 and the heat resistant belt F3. However, there may be a case where the frictional coefficients become unstable due to enter of foreign substances between the heat resistant belt F3 and the pressure roller F2 or between the heat resistant belt F3 and the belt tension member F4, or due to the abrasion of the contact portion between the heat resistant belt F3 and the pressure roller F2 or the belt tension member F4.

Accordingly, the winding angle of the heat resistant belt F3 with respect to the belt tension member F4 is set to be smaller than the winding angle of the heat resistant belt F3 with respect to the pressure roller F2, and the diameter of the belt tension member F4 is set to be smaller than the diameter of the pressure roller F2. With this configuration, the distance that the heat resistant belt F3 slides on the belt tension member F4 becomes short, such that unstable factors due to deterioration with the elapse of time or disturbance can be avoided. As a result, the heat resistant belt F3 can be driven with the pressure roller F2 in a stable manner.

A time (nip time) required until the toner particles pass through the fixing nip portion is preferably in a range of 0.02 to 0.2 seconds, and more preferably, 0.03 to 0.1 seconds. Even though the time required until the toner particles pass through the fixing nip portion is such short time, with the above-described liquid developer according to the embodiment of the invention, the toner particles can be sufficiently fixed, and thus a printing speed can be further increased.

A fixing temperature when the unfixed toner image is fixed is preferably in a range of 80 to 200° C., and more preferably, 80 to 180° C. If the fixing temperature falls within the above-described range, the oxidization polymerization reaction (curing reaction) of the unsaturated fatty acid component contained in the insulation liquid can be further effectively advanced. As a result, the toner particles can be solidly fixed onto the recording medium.

Figure 4:
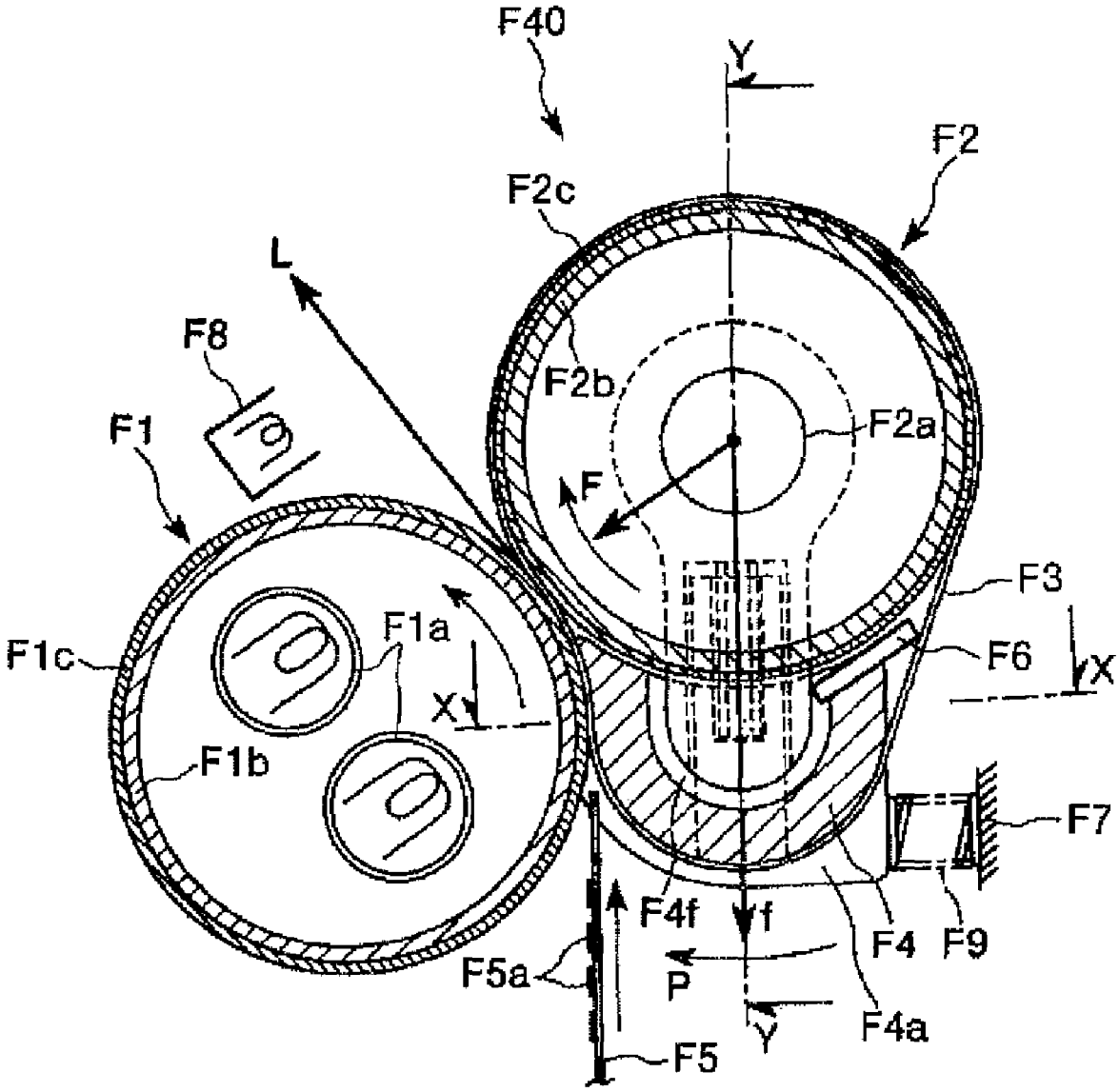
FIG. 4 is a cross-sectional view showing an example of a fixing device that constitutes an image forming apparatus according to an embodiment of the invention

Further, a fixing device shown in FIG. 4 may be used. FIG. 4 is a cross-sectional view showing an example of a fixing device that constitutes an image forming apparatus of the embodiment of the invention. The fixing device shown in FIG. 4 has the same configuration as the fixing device shown in FIG. 3, except that an ultraviolet irradiation unit F8 is provided.

The ultraviolet irradiation unit F8 has a function that irradiates an ultraviolet ray onto a surface of the recording medium F5 discharged as described above, on which the toner image F5*a* is formed. With this configuration, the unsaturated fatty acid component contained in the insulation liquid can be more solidly cured by heat and ultraviolet irradiation. As a result, the toner particles can be more solidly fixed on the recording medium. Further, with the ultraviolet irradiation, even though it is not heated by the heat fixing roller F1 at a particularly high temperature, the toner particles can be solidly fixed onto the recording medium. Accordingly, owing to the synergy effect by the effects of the liquid developer according to the embodiment of the invention, the toner particles can be fixed onto the recording medium at lower temperature and higher speed. Then, the toner particles can be more solidly fixed onto the recording medium. In addition, since a large amount of heat is not needed for fixing, even though the time until the recording medium passes through the fixing nip portion described above is set to a comparatively short time, the toner particles can be sufficiently fixed onto the recording medium through the ultraviolet irradiation. That is, since it takes little time to fix the toner image, a printing speed can be further increased. Further, since a large amount of heat is not needed to fix the toner image, power saving can be realized. As a result, an environment-friendly fixing device can be provided.

Although the invention has been described on the basis of the preferred embodiment, the invention -is not limited thereto.

For example, the liquid developer according to the embodiment of the invention is not limited to be used for the liquid developing device and the fixing device described above.

Further, the liquid developer according to the embodiment of the invention is not limited to a liquid developer that is manufactured by the above-described manufacturing method.

Although a case where the water-based emulsion is obtained and the associated particles are obtained by adding the electrolyte to the water-based emulsion has been described in the above-described embodiment, the invention is not limited thereto. For example, the associated particles may be prepared using an emulsion polymerization and association method that disperses a polymerization initiator of a colorant, a monomer, and a surfactant to a water-based liquid, prepares a water-based emulsion through emulsion polymerization, adds an electrolyte to the water-based emulsion, and performs association. Then, the resultant water-based emulsion is subject to spray drying, thereby obtaining the associated particles.

EXAMPLES

[1] Liquid Developer Preparation

Example 1

First, 80 parts by weight of polyester resin (softening temperature: 99° C.) and 20 parts by weight of a cyanogen-based pigment (pigment blue 15:3 manufactured by Dainichiseika Color & Chemicals Mfg. Co., Ltd.) as a colorant were prepared. These components were mixed using a 20 L type Henschel mixer to obtain a material for producing a toner.

Next, the material (mixture) was kneaded using a biaxial kneader-extruder. A kneaded material extruded from an extruding port of the biaxial kneader-extruder was cooled.

The kneaded material that had been cooled as described above was coarsely ground to be formed into powder having an average particle size of 1.0 mm or less (coarsely milled material). A hammer mill was used for coarse milling of the kneaded material.

Next, 100 parts by weight of the coarsely milled material obtained as described above, 100 parts by weight of methyl laurate (manufactured by NOF Corporation), 10 parts by weight of polyamine aliphatic polycondensate (product name: 'SOLSPERSE 11200' manufactured by Lubrizol Japan Ltd.) as a dispersant, and 1.0 part by weight of magnesium stearate as a charging controller were prepared. Moreover, viscosity of methyl laurate at 25° C. was 3 mPa·s.

The individual ingredients were put in a ball mill, and subjected to wet milling for 200 hours, to thereby obtain a milled material dispersion liquid.

Thereafter, 100 parts by weight of the resultant milled material dispersion liquid and 150 parts by weight of rape oil (manufactured by Nisshin Oillio Group, Ltd.) were mixed, to thereby obtain a liquid developer. Moreover, viscosity of rape oil 19° C. was 75 mPa·s.

In the resultant liquid developer, the average particle size of the toner particles was 1.2 μm, and the standard deviation in particle size between the toner particles was 0.62 μm. Further, viscosity of the liquid developer at a room temperature (20° C.) was 120 mPa·s.

Example 2

A liquid developer was prepared in the same manner as the example 1, except that methyl laurate was changed to methyl stearate. Moreover, viscosity of methyl stearate at 25° C. was 8 mPa·s.

Example 3

A liquid developer was prepared in the same manner as the example 1, except that rape oil was changed to soybean oil (manufactured by Nisshin Oillio Group, Ltd.). Moreover, viscosity of soybean oil at 19° C. was 67 mPa·s.

Example 4

A liquid developer was prepared in the same manner as the example 1, except that polyester resin was changed to epoxy resin (Epikote 1004, softening temperature: 128° C.).

Example 5

First, 80 parts by weight of polyester resin (softening temperature: 99° C.) and 20 parts by weight of cyanogen-based pigment (pigment blue 15:3 manufactured by Dainichiseika Color & Chemicals Mfg. Co., Ltd.) as a colorant were prepared. These ingredients were mixed using a 20 L type Henschel mixer, to thereby obtain a material for manufacturing a toner.

Next, the material (mixture) was kneaded using a biaxial kneader-extruder. A kneaded material extruded from the extruding port of the biaxial kneader-extruder was cooled.

The kneaded material that had been cooled as described above was coarsely ground to be formed into powder having an average particle size of 1.0 mm or less (coarsely milled material). A hammer mill was used for coarse milling of the kneaded material.

Next, 100 parts by weight of the coarsely milled material of the kneaded material was added to 250 parts by weight of toluene, and then it was subjected to a treatment for one hour using an ultrasound homogenizer (output: 400 μA), to thereby obtain a liquid in which the polyester resin of the kneaded material was dissolved. Moreover, in this solution, the pigment was homogeneously and finely dispersed.

Meanwhile, a water-based liquid in which 1 part by weight of sodium-dodecyl benzene sulfonic acid as a dispersant and 700 parts by weight of ion-exchange water were homogeneously mixed was prepared.

The water-based liquid was stirred with a homomixer (manufactured by PRIMIX Corporation) with the number of stirring being adjusted.

The above-described solution (the toluene solution of the kneaded material) was dropped in the water-based liquid in a stirred state, to thereby obtain a water-based emulsion in which a dispersoid having an average particle size of 0.5 μm was homogeneously dispersed. Moreover, the density of the solid content (dispersoid) in the resultant water-based emulsion was 20 wt %.

Next, 0.35 part by weight of a nonionic surfactant (product name 'Epan 450' manufactured by Dai-ichi Kogyo Seiyaku Co., Ltd.) was added to 100 parts by weight of the water-based emulsion under stirring.

Next, after the stirring speed had been adjusted and the temperature had been set to 30° C., 35 parts by weight of 3% aqueous ammonium sulfate solution was dropped in 100 parts by weight of the water-based emulsion, to thereby obtain an associated particle dispersion liquid in which associated particles were dispersed.

The associated particles were separated from the resultant associated particle dispersion liquid with a centrifugal separator, and then cleaning was performed. Thereafter, drying was performed with a vacuum drier, to thereby obtain the associated particles. The average particle size of the resultant associated particles was 5.2 μm.

Next, a 4 mm carbon chromium bead was put in a 500 mL vessel, and then 50 parts by weight of methyl caprylate (manufactured by Lion Co., Ltd.) and 10 parts by weight of polyamine aliphatic polycondensate (product name: 'SOLSPERSE 11200' manufactured by Lubrizol Japan Ltd.) as a dispersant were put in the vessel. Moreover, viscosity of methyl caprylate was 3 mPa·s.

Next, 50 parts by weight of the resultant associated particles were put in the vessel and mixed with a ball mill for ten minutes. Thereafter, 0.5 part by weight of magnesium stearate was put in the vessel as a charge controller, and disintegrated with a ball mill for 200 hours, to thereby obtain a toner dispersion liquid.

After the disintegration had been finished, 150 parts by weight of rape oil was put in the vessel and the toner particles were dispersed. The dispersion was performed with a ball mill for 24 hours while a 4 mm bead was put in the vessel, to thereby obtain a liquid developer.

In the resultant liquid developer, the average particle size of the toner particles was 1.3 μm, and standard deviation in the particle size between the toner particles was 0.50 μm. Further, viscosity of the liquid developer at a room temperature (20° C.) was 95 mPa·s.

Example 6

A liquid developer was prepared in the same manner as the example 5, except that fatty acid monoester was changed to methyl stearate (NOF Corporation). Moreover, viscosity of methyl stearate at 25° C. was 8 mPa·s.

Example 7

A liquid developer was prepared in the same manner as the example 5, except that rape oil was changed to soybean oil (manufactured by Nisshin Oillio Group, Ltd.). Moreover, viscosity of soybean oil at 19° C. was 67 mPa·s.

Example 8

A liquid developer was prepared in the same manner as the example 5, except that polyester resin was changed to epoxy resin (Epikote 1004, softening temperature: 128° C.).

Comparative Example 1

A coarsely milled material was prepared in the same manner as the example 1.

Next, 100 parts by weight of the resultant coarsely milled material, 100 parts by weight of soybean oil (manufactured by Nisshin Oillio Group, Ltd., viscosity (19° C.): 67 mPa·s), 10 parts by weight of polyoxyethylene alkyl ether as a dispersant, and 1.0 part by weight of magnesium stearate as a charging controller were prepared.

These ingredients were put in a ball mill and subjected to wet milling for 400 hours, to thereby obtain a milled material dispersion liquid.

Thereafter, 100 parts by weight of the resultant milled material dispersion liquid and 150 parts by weight of methyl laurate were mixed, to thereby obtain a liquid developer.

In the resultant liquid developer, the average particle size of the toner particles was 1.5 μm, and the standard deviation in particle size between the toner particles was 0.92 μm. Further, viscosity of the liquid developer at a room temperature (20° C.) was 72 mPa·s.

Comparative Example 2

A coarsely milled material was prepared in the same manner as the example 1.

Next, 100 parts by weight of the resultant coarsely milled material, 100 parts by weight of soybean oil (manufactured by Nisshin Oillio Group, Ltd., viscosity (19° C.): 67 mPa·s), 10 parts by weight of polyoxyethylene alkyl ether as a dispersant, and 1.0 part by weight of magnesium stearate as a charging controller were prepared.

These ingredients were put in a ball mill and subjected to wet milling for 300 hours, but toner particles having a sufficient size cannot be obtained.

Comparative Example 3

Associated particles were prepared in the same manner as the example 5.

Next, a 4 mm carbon-chromium bead was put in a 500 mL vessel, and then 50 parts by weight of soybean oil (manufactured by Nisshin Oillio Group, Ltd., viscosity (19° C.): 67 mPa·s) and 5 parts by weight of polyamine aliphatic polycondensate (product name 'SOLSPERSE 11200' manufactured by Lubrizol Japan Ltd.) as a dispersant were put in the vessel.

Next, 50 parts by weight of the resultant associated particles were put and mixed with a ball mill for ten minutes. Thereafter, 0.5 part by weight of magnesium stearate as a charge controller was put and disintegrated with a ball mill for 200 hours, to thereby obtain a toner dispersion liquid.

After the disintegration had been finished, 150 parts by weight of methyl laurate was put, and the toner particles were dispersed. The dispersion was performed with a ball mill for 24 hours while a 4 mm bead was put in the vessel, to thereby obtain a liquid developer.

In the resultant liquid developer, the average particle size of the toner particles was 1.8 μm, and the standard deviation in particle size between the toner particles was 0.85 μm. Further, viscosity of the liquid developer at a room temperature (20° C.) was 83 mPa·s.

The manufacturing conditions of the liquid developers in the individual examples and the individual comparative examples described above are described in Table 1.

TABLE 1

| | Resin Material | | Insulation Liquid | | | |
|---|---|---|---|---|---|---|
| | | | Liquid Used For Milling (Disintegration) | | Liquid Added After Milling (Disintegration) | |
| | Kind | Softening Temperature [° C.] | Kind | Viscosity [mPa · s] | Kind | Viscosity [mPa · s] |
| Example 1 | polyester resin | 99 | methyl laurate | 3 | rape oil | 75 |
| Example 2 | polyester resin | 99 | methyl stearate | 8 | rape oil | 75 |
| Example 3 | polyester resin | 99 | methyl laurate | 3 | soybean oil | 67 |
| Example 4 | epoxy resin | 128 | methyl laurate | 3 | rape oil | 75 |
| Example 5 | polyester resin | 99 | methyl caprylate | 3 | rape oil | 75 |
| Example 6 | polyester resin | 99 | methyl stearate | 8 | rape oil | 75 |
| Example 7 | polyester resin | 99 | methyl caprylate | 3 | soybean oil | 67 |
| Example 8 | epoxy resin | 128 | methyl caprylate | 3 | rape oil | 75 |
| Comparative Example 1 | polyester resin | 99 | soybean oil | 67 | methyl laurate | 3 |
| Comparative Example 2 | polyester resin | 99 | soybean oil | 67 | — | — |
| Comparative Example 3 | polyester resin | 99 | soybean oil | 67 | methyl laurate | 3 |

[2] Evaluation

The individual liquid developers obtained as described above were subjected to the following evaluation.

[2.1] Fixing Strength

An image having a predetermined pattern by the liquid developer in each of the examples and the comparative examples was formed on a recording paper (a bond paper LPCPPA4 manufactured by Seiko Epson Corporation) using the liquid developing device shown in FIG. 1. Thereafter, in respect to the image formed on the recording paper, heat fixing was performed with an oven. The heat fixation was performed at 120° C. for 30 minutes.

Thereafter, after a non-offset region had been confirmed, the fixed image on the recording paper was rubbed two times with an eraser (a sand eraser 'LION 261-11' manufactured by Lion Office Products Corp.) with a pressure load 1.2 kgf, and an image density residual rate was measured by 'X-Rite model 404' manufactured by X-Rite Inc. Then, the evaluation was performed on the following five-step standard.

◎◎: Image density residual rate was 95% or higher.

◎: Image density residual rate was 90% or higher but lower than 95%.

○: Image density residual rate was 80% or higher but lower than 90%.

Δ: Image density residual rate was 70% or higher but lower than 80%.

x: Image density residual rate was lower than 70%.

[2.2] Dispersion Stability Test 10 mL of the liquid developer obtained in each of the examples and the comparative examples was put in a centrifugal tube and under a centrifugal separator on the condition 1000 G and 10 minutes. Thereafter, the supernatant 200 μL was collected and diluted 100 times than the insulation liquid used in each of the examples and the comparative examples, to thereby obtain a sample.

The absorption wavelength of each sample was measured using a visible-ultraviolet spectrophotometer (V-570 manufactured by JASCO Corporation).

The evaluation was performed from the value of absorbance of an absorption band (685 nm) of a cyanogen-based pigment on the basis of the following four-step standard.

◎: Absorbance was 1.50 or higher (sedimentation is not observed at all).

○: Absorbance was 1.00 or higher but lower than 1.50 (sedimentation is not almost observed).

Δ: Absorbance was 0.50 or higher but lower than 1.00 (sedimentation is observed).

x: Absorbance was lower than 0.50 (sedimentation is remarkably observed and starts while it has been left).

[2.3] Preservation Property

The liquid developer obtained in each of the examples and the comparative examples was left for six months under the environment of temperature 15 to 25° C. Thereafter, the shape of the toner in the liquid developer was confirmed by a naked eye and evaluated on the basis of the following five-step standard.

◎◎: Release and aggregation/sedimentation of toner particles were not observed at all.

◎: Release and aggregation/sedimentation of toner particles were not almost observed.

○: Release and aggregation/sedimentation of toner particles were scarcely observed, but this range does not matter as the liquid developer.

Δ: Release and aggregation/sedimentation of toner particles were obviously observed.

x: Release and aggregation/sedimentation of toner particles were clearly observed.

[2.4] Evaluation of Uneven Distribution of Fatty Acid Monoester

In respect to the individual examples and the individual comparative examples, a liquid after milling (in the examples 5 to 8 and the comparative example 2, disintegration) with a ball mill for one hour and the resultant liquid developer were separately subjected to centrifugal separation, and supernatants were removed, to thereby retract the solid content.

The solid content was heated to 50° C., and a change in weight was measured with a precision balance. Then, according to the following standard, it was evaluated whether or not fatty acid monoester exists on the surface of the toner particle.

○: A weight 0.005 g or higher was superimposed, and fatty acid monoester was unevenly distributed in the vicinity of the surfaces of the toner particles.

x: A change in weight was lower than 0.005 g, and fatty acid monoester was not unevenly distributed in the vicinity of the surfaces of the toner particles.

The results are shown in Table 2, together with viscosity of the liquid developer, the average particle size of the toner particles based on the volume, and the standard deviation in particle size.

TABLE 2

| | Viscosity of Liquid Developer [mPa · s] | Average Particle Size [μm] | Standard Deviation in Particle Size [μm] | Evaluation | | | |
|---|---|---|---|---|---|---|---|
| | | | | Fixing Strength | Dispersion Stability | Preservation Property | Uneven Distribution Of Fatty Acid Monoester |
| Example 1 | 120 | 1.2 | 0.62 | ◎◎ | ◎ | ◎◎ | ○ |
| Example 2 | 145 | 1.3 | 0.56 | ◎◎ | ◎ | ◎◎ | ○ |
| Example 3 | 115 | 1.2 | 0.52 | ◎◎ | ◎ | ◎◎ | ○ |
| Example 4 | 131 | 1.4 | 0.54 | ◎◎ | ○ | ◎ | ○ |
| Example 5 | 95 | 1.3 | 0.50 | ◎◎ | ◎ | ◎◎ | ○ |
| Example 6 | 152 | 1.2 | 0.49 | ◎◎ | ◎ | ◎◎ | ○ |
| Example 7 | 121 | 1.1 | 0.58 | ◎◎ | ◎ | ◎◎ | ○ |
| Example 8 | 141 | 1.3 | 0.60 | ◎◎ | ○ | ◎ | ○ |
| Comparative Example 1 | 72 | 1.5 | 0.92 | X | Δ | Δ | X |
| Comparative Example 2 | — | — | — | — | — | — | — |
| Comparative Example 3 | 83 | 1.8 | 0.85 | X | Δ | Δ | X |

As will be apparent from Table 2, the liquid developer according to the invention has excellent fixing strength, dispersion stability, and preservation property. In contrast, in a case of the liquid developer of the individual comparative examples, satisfactory results were not obtained. Further, in the individual examples, it was confirmed that the fatty acid monoester was unevenly distributed on the surfaces of the toner particles in the resultant liquid developer. In contrast, in the comparative examples, the uneven distribution of the fatty acid monoester was not confirmed.

In addition, when a liquid developer was prepared and evaluated in the same manner as described above, except that pigment red 122, pigment yellow 180, or carbon black (Printex L manufactured by Degussa Corporation), instead of the cyanogen-based pigment, was used as the colorant, the same results as described above were obtained.

[3] Liquid Developer Preparation

Example 9

Preparation of Liquid Constituting Insulation Liquid

As the insulation liquid, a liquid mainly containing unsaturated fatty acid triglyceride and a liquid mainly containing unsaturated fatty acid methyl ester were prepared in the following manner.

First, coarse soybean oil was purified in the following manner, to thereby obtain a purified soybean oil.

Initially, as a medium, coarse soybean oil was coarsely purified using a low-temperature crystallization method using methanol, diethylether, petroleum ether, and acetone.

Next, 300 parts by volume of the purified coarse soybean oil (first coarsely purified oil) was put in a flask. Thereafter, 100 parts by volume of boiled water was poured into the flask, and then the flask was plugged.

Next, the flask was shaken such that coarse soybean oil (first coarsely refined oil) and boiled water were mixed.

Next, the flask had been left until the mixed solution in the flask was separated into three layers.

After it was confirmed that the mixed solution was completely separated, the flask was put in a freezer and left for 24 hours.

Subsequently, an unfrozen component in the mixed solution was taken out and put in a different flask.

The unfrozen component was again subjected to the same operation as described above. Then, an unfrozen component was taken out to obtain coarsely refined fatty oil (second coarsely refined oil).

Next, 100 parts by volume of the coarsely refined fatty oil (second coarsely refined oil) obtained as described above and 35 parts by volume of activated earth mainly containing hydrous silicic aluminum were mixed and stirred in a flask.

Next, the resultant mixture was left for 48 hours under a pressure (0.18 MPa) such that the activated earth was completely settled down.

Then, the precipitation was removed to thereby obtain refined soybean oil (hereinafter, simply referred to 'soybean oil'). Moreover, fatty acid triglyceride mainly containing linoleic acid was contained in the soybean oil, and the amount of unsaturated fatty acid triglyceride in the soybean oil was 98 wt %. Further, the linoleic acid component was 53 mol % in the entire fatty acid components.

Next, an ester interchange reaction between a portion of the soybean oil and methanol was performed, and glycerine generated by the above reaction was taken out, to thereby obtain a liquid mainly containing fatty acid monoester. In addition, the liquid was refined, to thereby obtain soybean fatty acid methyl in which the content of fatty acid monoester was 99.9 wt % or more. The fatty acid monoester obtained as described above mainly contains unsaturated fatty acid monoester, such as methyl oleate, methyl linoleate, or α-methyl linoleate, and saturated fatty acid monoester, such as methyl palmitate or methyl stearate.

Further, coarse high-oleic rape oil was refined with the same operation as the soybean oil, to thereby obtain refined high-oleic rape oil (hereinafter, simply referred to as 'high-oleic rape oil'). Moreover, fatty acid triglyceride mainly containing oleic acid was contained in the high-oleic rape oil, and unsaturated fatty acid triglyceride in the high-oleic rape oil was 98 wt %. In addition, the oleic acid component and the linoleic acid component were 58 mol % and 24 mol % in the entire fatty acid components, respectively.

Next, an ester interchange reaction between a portion of the high-oleic rape oil and methanol was performed, and glycerine generated by the above reaction was taken out, to thereby obtain a liquid mainly containing fatty acid monoester. In addition, the liquid was refined, to thereby obtain rape oil fatty acid methyl in which the content of fatty acid monoester was 99.9 wt % or more.

Colorant Master Solution Preparation

First, a mixture (mass ratio 50:50) of polyester resin (softening temperature: 99° C.) and a cyanogen-based pigment (pigment blue 15:3 manufactured by Dainichiseika Color & Chemicals Mfg. Co., Ltd.) as a colorant were prepared. These ingredients were mixed using a 20 L type Henschel mixer, to thereby obtain a material for producing a toner.

Next, the material (mixture) was kneaded using a biaxial kneader-extruder. A kneaded material extruded from an extruding port of the biaxial kneader-extruder was cooled.

The kneaded material that had been cooled as described above was coarsely ground to be formed into powder having an average particle size of 1.0 mm or less. A hammer mill was used for coarse grounding of the kneaded material.

Methyl ethyl ketone was added such that the solid content in the resultant powder of the kneaded material reaches 30 mass %. Then, wet dispersion was performed using Eiger Motormill (M-1000 manufactured by Eiger Machinery Inc., U.S.) to thereby prepare a colorant master solution.

Resin Liquid Preparation 140 parts by weight of methyl ethyl ketone and 60 parts by weight of polyester resin were added to 133 parts by weight of the colorant master solution, and mixed with Eiger Motormill (M-1000 manufactured by Eiger Machinery Inc., U.S.) to thereby produce a resin liquid. Moreover, in this solution, a pigment was homogeneously and finely dispersed.

Water-Based Emulsion Preparation (Water-Based Emulsion Preparation Process)

500 parts by weight of the resin liquid and 45.5 parts by weight of methyl ethyl ketone were put in a 2 L cylindrical separable flask having a 'Max blend' stirring wing, such the solid content of the resin liquid was set to 55%.

Next, 41.7 parts by weight of 1 normal ammonia water (a molar equivalent ratio with respect to the total amount of a carboxyl group of polyester resin was 1.1) was added to the resin liquid in the flask, and then sufficiently stirred with a three-one motor (manufactured by Shinto Scientific Co., Ltd.) at a revolution number of 210 rpm of the stirring wing (the peripheral velocity of the stirring wing: 0.71 m/s). Thereafter, 133 parts by weight of deionized water was added under stirring. The temperature of the liquid in the flask was adjusted to 25° C., and 133 parts by weight of deionized water was dropped in the resin liquid under stirring to cause a phase inversion emulsification, thereby obtaining a water-based emulsion in which the dispersoid containing the resin material was dispersed.

Associated Particle Manufacturing with Association (Associated Particle Forming Process)

Next, while keeping stirring the inside of the flask, 285 parts by weight of deionized water was added to the water-based emulsion, such that the total amount of 1 normal ammonia water and water reached 593 parts by weight. Next, 2.6 parts by weight of EMAL 0 (manufactured by Kao Corporation) as an anionic emulsifier was diluted by 30 parts by weight of deionized water and then added to the water-based emulsion.

Thereafter, while the temperature of the water-based emulsion was maintained at 25° C., at the revolution number of 150 rpm (the peripheral velocity of the stirring wing: 0.54 m/s), 300 parts by weight of a 3.5% aqueous ammonium sulfate solution was dropped, such that the particle size of an associate of the dispersoid was set to 3. 5 μm. After dropping, stirring was continued until the particle size of the associate of the dispersoid was grown to 5.2 μm and then the association operation was finished.

After an organic solvent was distilled from the obtained associate dispersion liquid under a reduced pressure, and then cleaning and anhydration were repeatedly performed. Therefore, drying was performed to thereby obtain associated particles. Moreover, the average particle size in each of the examples and the comparative examples is an average particle size based on the volume, and the average particle size and the particle size distribution of the particles were measured with a Mastersizer 2000 particle size analyzer (Malvern Instrument Ltd.).

Associated Particle Disintegration (Disintegration Process)

50 parts by weight of the associated particles and 80 parts by weight of soybean oil fatty acid methyl obtained by the above-described method, 1 part by weight of polyamine aliphatic polycondensate (product name: 'SOLSPERSE 13940' manufactured by Lubrizol Japan Ltd.) as the dispersant, and 0.5 part by weight of aluminum stearate (manufactured by NOF Corporation) as the charging controller were put in a zirconia pot (inner volume 500 ml), and a steel bead (a bead diameter: 1 mm) was put in the zirconia pot to reach a volume filling ratio 30%. Then, disintegration was performed using a rotating ball mill (ANZ51S manufactured by AS ONE Corporation) at a rotation speed 210 rpm for 48 hours.

Manufacturing of Liquid Developer (Dispersion Process)

After the disintegration had been finished, 120 parts by weight of high-oleic rape oil was put and mixed. The mixture was performed by stirring with the volume filling ratio 30% at the rotation speed 210 rpm for 24 hours using the same ball mill and steel bead (the bead diameter: 1 mm). Accordingly, a liquid developer was obtained. In the resultant liquid developer, the average particle size of the toner particles was 1.3 μm, and the standard deviation in particle size between the toner particles was 0.47 μm. Further, electrical resistance of the liquid developer was $3.1\times10^{12}$ Ωcm, electrical resistance of the mixture of the used insulation liquid was $2.6\times10^{13}$ Ωcm. Moreover, in this specification, electrical resistance of the liquid was measured with a universal electrometer (MMAII-17B manufactured by Kawaguchi Electric Works Co., Ltd.), to which an electrode for liquid (LP-05 manufactured by Kawaguchi Electric Works Co., Ltd.) and a shield box (P-618 manufactured by Kawaguchi Electric Works Co., Ltd.) are attached, at a room temperature (20° C.).

Examples 10 to 12

A liquid developer was prepared in the same manner as the example 9, except that an insulation liquid in Table 3 was used as an insulation liquid used for disintegration and an insulation liquid added after disintegration.

Example 13

Coarse high-oleic safflower oil was refined with the same operation as the soybean oil, to thereby obtain refined high-oleic safflower oil (hereinafter, simply referred to as 'high-oleic safflower oil'). Moreover, fatty acid triglyceride mainly containing oleic acid was contained in the high-oleic safflower oil, and the amount of unsaturated fatty acid triglyceride in the high-oleic safflower oil was 98 wt %. In addition, the oleic acid component and the linoleic acid component were 76 mol % and 16 mol % in the entire fatty acid components, respectively.

Hereinafter, a liquid developer was prepared in the same manner as the example 9, except that 120 parts by weight of high-oleic safflower oil, instead of 120 parts by weight of high-oleic rape oil, was used as the insulation liquid to be added after disintegration.

Example 14

Coarse high-oleic sunflower oil was refined with the same operation as the soybean oil, to thereby obtain refined high-oleic sunflower oil (hereinafter, simply referred to as 'high-oleic sunflower oil') Moreover, fatty acid triglyceride mainly containing oleic acid was contained in the high-oleic sunflower oil, and the amount of unsaturated fatty acid triglyceride in the high-oleic sunflower oil was 98 wt %. Further, the oleic acid component and the linoleic acid component were 80 mol % and 11 mol % in the entire fatty acid components, respectively.

Hereinafter, a liquid developer was prepared in the same manner as the example 9, except that 120 parts by weight of high-oleic sunflower oil, instead of 120 parts by weight of high-oleic rape oil, was used as the insulation liquid to be added after disintegration.

Examples 15 and 16

A liquid developer was prepared in the same manner as the example 9, except that the insulation liquids shown in Table 3 were used as the insulation liquid to be used for disintegration and the insulation liquid to be used after disintegration.

Examples 17 to 20

A liquid developer was prepared in the same manner as the example 9, except that polyamine aliphatic polymer was added as the dispersant to be used for disintegration, as shown in Table 3.

Example 21

A liquid developer was prepared in the same manner as the example 9, except that epoxy resin (softening temperature: 128° C.) was used as the resin material.

Examples 22 to 24

A liquid developer was prepared in the same manner as the example 9, except that a dispersant described in Table 3 was used as the dispersant to be used for disintegration.

Example 25

80 parts by weight of polyester resin (softening temperature: 99° C.) and 20 parts by weight of a cyanogen-based, pigment (pigment blue 15:3 manufactured by Dainichiseika Color & Chemicals Mfg. Co., Ltd.) as the colorant were kneaded at 135° C. exceeding the softening point of resin with a double-roll, and then coarsely ground at 1 to 10 mm square, to thereby obtain colored tips.

Next, the colored tips were ground with a pin mill while being cooled by liquid nitrogen, and then removed by a sieve of 150 μm mesh, to thereby obtain a pulverized material having an average particle size of 42 μm.

In addition, milling was performed with an impact pulverizer, to thereby obtain dry powder having the average particle size of 5 μm.

50 parts by weight of the associated particles and 80 parts by weight of soybean oil fatty acid methyl obtained by the above-described method, 1 part by weight of polyamine aliphatic polycondensate (product name: 'SOLSPERSE 13940' manufactured by Lubrizol Japan Ltd.) as the dispersant, and 0.5 part by weight of aluminum stearate (manufactured by NOF Corporation) as the charging controller were put in a zirconia pot (inner volume 500 ml), and a steel bead (a bead diameter: 1 mm) was put in the zirconia pot to reach a volume filling ratio 30%. Then, disintegration was performed using a rotating ball mill (ANZ51S manufactured by AS ONE Corporation) at a rotation speed 210 rpm for 240 hours.

After the disintegration has been finished, 120 parts by weight of high-oleic rape oil was put in the pot and then mixed. The mixture was performed by stirring with the volume filling ratio 30% at the rotation speed 210 rpm for 24 hours using the same ball mill and steel bead (the bead diameter: 1 mm). Accordingly, a liquid developer was obtained. In the resultant liquid developer, the average particle size of the toner particles was 2.3 μm, and the standard deviation in particle size between the toner particles was 0.98 μm.

Comparative Example 4

In the preparation of the water-based emulsion, the preparation conditions, such as the stirring speed and the like, or the additive amount and condition of the electrolyte (ammonium sulfate) were appropriately adjusted such that the average particle size of the associated particles in the associated particle dispersion liquid was 1.7 μm.

Next, the associated particles was separated from the associated particles dispersion liquid in the same manner as the example 9 and then dried.

Next, 50 parts by weight of the resultant associated particles, 80 parts by weight of soybean oil fatty acid methyl, 120 parts by weight of high-oleic rape oil, 1.0 part by weight of polyamine aliphatic polycondensate as the dispersant, and 0.5 part by weight of aluminum stearate as the charging controller were mixed, to thereby obtain a liquid developer. Moreover, in the resultant liquid developer, the average particle size of the toner particles was 1.5 μm, and the standard deviation in particle size between the toner particles was 0.80 μm.

Comparative Examples 5 to 7

A liquid developer was prepared in the same manner as the example 99, except that the insulation liquids shown in Table 3 were used as the insulation liquid to be used for disintegration and the insulation liquid to be added after disintegration.

Comparative Example 8

A liquid developer was prepared in the same manner as the example 25, except that the insulation liquids shown in Table 3 were used as the insulation liquid to he used for milling and the insulation liquid to be added after milling.

In respect to the individual examples and the individual comparative examples described above, the preparation conditions of the liquid developers were shown in Table 3. Moreover, in Table 3, in the columns 'Insulation Liquid Used For Disintegration' of the example 25 and the comparative example 8, the kind of the insulation liquid used for the milling was described. Further, in the column 'Insulation Liquid Added After Disintegration' of the comparative example 3, the kind of the used insulation liquid was described. In addition, in Table 3, 'HO' represents 'high-oleic'. The weight-average molecular weights of the dispersants used for disintegration and milling described in Table 3 were within a range of 5000 to 80000.

TABLE 3

| | Resin Material | | Average Particle Size of | Insulation Liquid Used For Disintegration (Milling) | | Isulation Liquid Added After Disintegration (milling) | | Dispersant Used for | Content of Dispersant In Liquid | Content Of Toner Particles In Liquid | |
|---|---|---|---|---|---|---|---|---|---|---|---|
| | Kind | Softening Temperature [° C.] | Associated Particles [μm] | Kind | Viscosity [mPa · s] | Kind | Viscosity [mPa · s] | Disintegration (Milling) | Developer A [wt %] | Developer B [wt %] | A/B |
| Example 9 | polyester resin | 99 | 5.2 | soybean oil fatty acid methyl | 6.6 | HO rape oil | 75 | polyamine aliphatic polycondensate | 0.40 | 19.9 | 0.020 |
| Example 10 | polyester resin | 99 | 5.2 | soybean oil fatty acid methyl | 6.6 | soybean oil | 67 | polyamine aliphatic polycondensate | 0.40 | 19.9 | 0.020 |
| Example 11 | polyester resin | 99 | 5.2 | rape oil fatty acid methyl | 6.8 | soybean oil | 67 | polyamine aliphatic polycondensate | 0.40 | 19.9 | 0.020 |
| Example 12 | polyester resin | 99 | 5.2 | rape oil fatty acid methyl | 6.8 | HO rape oil | 75 | polyamine aliphatic polycondensate | 0.40 | 19.9 | 0.020 |

TABLE 3-continued

| | Resin Material | | Average Particle Size of | Insulation Liquid Used For Disintegration (Milling) | | Isulation Liquid Added After Disintegration (milling) | | Dispersant Used for | Content of Dispersant In Liquid | Content Of Toner Particles In Liquid | |
|---|---|---|---|---|---|---|---|---|---|---|---|
| | Kind | Softening Temperature [° C.] | Associated Particles [μm] | Kind | Viscosity [mPa · s] | Kind | Viscosity [mPa · s] | Disintegration (Milling) | Developer A [wt %] | Developer B [wt %] | A/B |
| Example 13 | polyester resin | 99 | 5.2 | rape oil fatty acid methyl | 6.8 | HO safflower oil | 84 | polyamine aliphatic polycondensate | 0.40 | 19.9 | 0.020 |
| Example 14 | polyester resin | 99 | 5.2 | soybean oil fatty acid methyl | 6.6 | HO sunflower oil | 93 | polyamine aliphatic polycondensete | 0.40 | 19.9 | 0.020 |
| Example 15 | polyester resin | 99 | 5.2 | methyl caprylate | 4.5 | HO rape oil | 75 | polyamine aliphatc polycondensate | 0.40 | 19.9 | 0.020 |
| Example 16 | polyester resin | 99 | 5.2 | methyl stearate | 7.3 | HO rape oil | 75 | polyamine aliphatic polycondensate | 0.40 | 19.9 | 0.020 |
| Example 17 | polyester resin | 99 | 5.2 | soybean oil fatty acid methyl | 6.6 | HO rape oil | 75 | polyamine aliphatic polycondensate | 0.08 | 20.0 | 0.004 |
| Example 18 | polyester resin | 99 | 5.2 | soybean oil fatty acid methyl | 6.6 | HO rape oil | 75 | polyamine aliphatic polycondensate | 0.16 | 20.0 | 0.008 |
| Example 19 | polyester resin | 99 | 5.2 | soybean oil fatty acid methyl | 6.6 | HO rape oil | 75 | polyamine aliphatc polycondensate | 1.96 | 19.6 | 0.100 |
| Example 20 | polyester resin | 99 | 5.2 | soybean oil fatty acid methyl | 6.6 | HO rape oil | 75 | polyamine aliphatc polycondensate | 3.10 | 19.4 | 0.160 |
| Example 21 | epoxy resin | 128 | 5.2 | soybean oil fatty acid methyl | 6.6 | HO rape oil | 75 | polyamine aliphatic polycondensate | 0.40 | 19.9 | 0.020 |
| Example 22 | polyester resin | 99 | 5.2 | soybean oil fatty acid methyl | 6.6 | HO rape oil | 75 | sorbitan fatty acid ester | 0.40 | 19.9 | 0.020 |
| Example 23 | polyester resin | 99 | 5.2 | soybean oil fatty acid methyl | 6.6 | HO rape oil | 75 | polyglyceine fatty acid ester | 0.40 | 19.9 | 0.020 |
| Example 24 | polyester resin | 99 | 5.2 | soybean oil fatty acid methyl | 6.6 | HO rape oil | 75 | sorbitan derivative nonionic surfactant | 0.40 | 19.9 | 0.020 |
| Example 25 | polyester resin | 99 | — | soybean oil fatty acid methyl | 6.6 | HO rape oil | 75 | polyamine aliphatic polycondensate | 0.40 | 19.9 | 0.020 |
| Comparative Example 4 | polyester resin | 99 | 1.7 | — | — | HO rape oil soybean oil fatty acid methyl | 75 6.6 | polyamine aliphatc polycondensate | 0.40 | 19.9 | 0.020 |
| Comparative Example 5 | polyester resin | 99 | 5.2 | soybean oil | 66 | soybean oil fatty acid methyl | 6.6 | polyamine aliphatc polycondensate | 0.40 | 19.9 | 0.020 |
| Comparative Example 6 | polyester resin | 99 | 5.2 | soybean oil | 66 | rape oil fatty acid methyl | 6.8 | polyamine aliphatc polycondensate | 0.40 | 19.9 | 0.020 |
| Comparative Example 7 | polyester resin | 99 | 5.2 | low-viscosity liquid parafin | 10 | high-viscosity liquid parafin | 200 | polyamine aliphatc polycondensate | 0.40 | 19.9 | 0.020 |
| Comparative Example 8 | polyester resin | 99 | — | soybean oil | 66 | soybean oil fatty acid methyl | 6.6 | polyamine aliphatc polycondensate | 0.40 | 19.9 | 0.020 |

[2] Evaluation

The individual liquid developers obtained as described above were subjected to the following evaluation.

[2.1] Fixing Strength

An image having a predetermined pattern by the liquid developer in each of the examples and the comparative examples was formed on a recording paper (a high-quality paper LPCPPA4 manufactured by Seiko Epson Corporation) using the liquid developing device shown in FIG. 1. Thereafter, in respect to the image formed on the recording paper, heat fixing was performed with an oven. The heat fixation was performed at 120° C. for 5 minutes.

Thereafter, after a non-offset region had been confirmed, the fixed image on the recording paper was rubbed two times with an eraser (a sand eraser 'LION 261-11' manufactured by Lion Office Products Corp.) with a pressure load 1.2 kgf, and an image density residual rate was measured by 'X-Rite model 404' manufactured by X-Rite Inc. Then, the evaluation was performed on the following five-step standard.

◎◎: Image density residual rate was 95% or higher.

◎: Image density residual rate was 90% or higher but lower than 95%.

○: Image density residual rate was 80% or higher but lower than 90%.

Δ: Image density residual rate was 70% or higher but lower than 80%.

x: Image density residual rate was lower than 70%.

[2.2] Dispersion Stability Test 10 mL of the liquid developer obtained in each of the examples and the comparative examples was put in a centrifugal tube and under a centrifugal separator on the condition 1200 G and 10 minutes. Thereafter, the supernatant 200 μL was collected and diluted 100 times than the insulation liquid used in each of the examples and the comparative examples, to thereby obtain a sample.

The absorption wavelength of each sample was measured using a visible-ultraviolet spectrophotometer (V-570 manufactured by JASCO Corporation).

The evaluation was performed from the value of absorbance of an absorption band (685 nm) of a cyanogen-based pigment on the basis of the following four-step standard.

◎: Absorbance was 1.50 or higher (sedimentation is not observed at all).

○: Absorbance was 1.00 or higher but lower than 1.50 (sedimentation is not almost observed).

Δ: Absorbance was 0.50 or higher but lower than 1.00 (sedimentation is observed).

x: Absorbance was lower than 0.50 (sedimentation is remarkably observed and starts while it has been left).

[2.3] Preservation Property

The liquid developer obtained in each of the examples and the comparative examples was left for nine months under the environment of temperature 15 to 25° C. Thereafter, the shape of the toner in the liquid developer was confirmed by a naked eye and evaluated on the basis of the following five-step standard.

◎◎: Release and aggregation/sedimentation of toner particles were not observed at all.

◎: Release and aggregation/sedimentation of toner particles were not almost observed.

○: Release and aggregation/sedimentation of toner particles were scarcely observed, but this range does not matter as the liquid developer.

Δ: Release and aggregation/sedimentation of toner particles were obviously observed.

x: Release and aggregation/sedimentation of toner particles were clearly observed.

[2.4] Evaluation of Uneven Distribution of Fatty Acid Monoester

In respect to the individual examples and the individual comparative examples, a liquid after disintegration (in the example 8 and the comparative example 2, milling) with a ball mill for one hour and the resultant liquid developer were separately subjected to centrifugal separation, and supernatants were removed, to thereby retract the solid content.

The solid content was heated to 50° C., and a change in weight was measured with a precision balance. Then, according to the following standard, it was evaluated whether or not fatty acid monoester exists on the surface of the toner particle.

○: A weight 0.005 g or higher was superimposed, and fatty acid monoester was unevenly distributed in the vicinity of the surfaces of the toner particles.

x: A change in weight was lower than 0.005 g, and fatty acid monoester was not unevenly distributed in the vicinity of the surfaces of the toner particles.

[2.5] Evaluation of Uneven Distribution of Dispersant

As described above, when the dispersant is dissolved and dispersed in the insulation liquid, electrical resistance of the liquid developer is not high. Meanwhile, when the dispersant is unevenly distributed in the vicinity of the surfaces of the toner particles, electrical resistance of the liquid developer is high. Form this viewpoint, it was evaluated as described below whether or not the dispersant is unevenly distributed in the vicinity of the surfaces of the toner particles.

In respect to the individual examples and the individual comparative examples, electrical resistance C [Ωcm] of the resultant liquid developer, and electrical resistance D [Ωcm] of a liquid having the same composition as the insulation liquid of the liquid developer (for example, in the example 1, a mixture of 80 parts by weight of soybean oil fatty acid methyl and 120 parts by weight of high-oleic tape oil) were measured. Further, electrical resistance of the liquid was measured with a universal electrometer (MMAII-17B manufactured by Kawaguchi Electric Works Co., Ltd.), to which an electrode for liquid (LP-05 manufactured by Kawaguchi Electric Works Co., Ltd.) and a shield box (P-618 manufactured by Kawaguchi Electric Works Co., Ltd.) are attached, at a room temperature (20° C.). In respect to the relationship between electrical resistance C of the liquid developer [Ωcm] and electrical resistance D [Ωcm] of the used insulation mixture, the evaluation was performed on the basis of the following four-step standard. As a degree of uneven distribution of the dispersant in the vicinity of the surfaces of the toner particles is high, the value C/D is becomes higher.

◎: C/D was 0.07 or higher (almost all the dispersant was unevenly distributed on the surfaces of the toner particles)

○: C/D was 0.015 or higher but lower than 0.07 (much dispersant was unevenly distributed on the surfaces of the toner particles)

Δ: C/D was 0.01 or higher but lower than 0.015 (slight dispersant was unevenly distributed on the surfaces of the toner particles)

x: C/D was lower than 0.01 (almost all dispersant was not unevenly distributed on the surfaces of the toner particles)

These results are shown in Table 4 together with the properties of the liquid developer.

TABLE 4

| | Liquid Developer | | | | Evaluation | | | | |
|---|---|---|---|---|---|---|---|---|---|
| | Toner Particle | | Viscocity of | | | | | Uneven Distribution on Surface of Toner Particle | |
| | Average Particle Size [μm] | Standard Deviation In Particle Size [μm] | Liquid Developer [mPa · s] | Electrical Resistance $\times 10^{12}$ [Ωcm] | Fixing Strength | Dispersion Stability | Preservation Property | fatty acid mono-ester | Disperant |
| Example 9 | 1.3 | 0.47 | 260 | 3.1 | ◎ | ◎ | ◎◎ | ○ | ◎ |
| Example 10 | 1.2 | 0.48 | 270 | 2.6 | ◎ | ◎ | ◎◎ | ○ | ◎ |
| Example 11 | 1.2 | 0.47 | 250 | 1.4 | ◎ | ◎ | ◎◎ | ○ | ◎ |
| Example 12 | 1.3 | 0.46 | 260 | 2.3 | ◎ | ◎ | ◎◎ | ○ | ◎ |
| Example 13 | 1.3 | 0.48 | 280 | 2.7 | ◎ | ◎ | ◎◎ | ○ | ◎ |
| Example 14 | 1.2 | 0.48 | 280 | 2.9 | ◎ | ◎ | ◎◎ | ○ | ◎ |
| Example 15 | 1.2 | 0.45 | 220 | 3.3 | ○ | ◎ | ◎◎ | ○ | ◎ |
| Example 16 | 1.2 | 0.50 | 200 | 3.4 | ○ | ◎ | ◎◎ | ○ | ◎ |
| Example 17 | 1.7 | 0.57 | 480 | 3.6 | ◎ | ○ | ◎ | ○ | ◎ |
| Example 18 | 1.4 | 0.51 | 240 | 3.5 | ◎ | ◎ | ◎◎ | ○ | ◎ |
| Example 19 | 1.3 | 0.48 | 190 | 1.9 | ◎ | ◎ | ◎◎ | ○ | ◎ |
| Example 20 | 1.2 | 0.47 | 130 | 1.1 | ○ | ◎ | ◎◎ | ○ | ○ |
| Example 21 | 1.7 | 0.63 | 320 | 1.4 | ○ | ○ | ◎ | ○ | ○ |
| Example 22 | 1.3 | 0.50 | 270 | 2.6 | ◎ | ◎ | ◎◎ | ○ | ◎ |
| Example 23 | 1.3 | 0.51 | 280 | 2.3 | ◎ | ◎ | ◎◎ | ○ | ◎ |
| Example 24 | 1.4 | 0.56 | 350 | 1.2 | ◎ | ◎ | ◎ | ○ | ◎ |
| Example 25 | 2.3 | 0.98 | 430 | 0.43 | ○ | ○ | ○ | ○ | ○ |
| Comparative Example 4 | 1.5 | 0.80 | 230 | 0.17 | X | X | Δ | X | X |
| Comparative Example 5 | 1.5 | 0.58 | 210 | 1.3 | X | Δ | Δ | X | ◎ |
| Comparative Example 6 | 1.6 | 0.52 | 220 | 1.2 | X | Δ | Δ | X | ◎ |
| Comparative Example 7 | 1.3 | 0.50 | 290 | 0.33 | X | X | Δ | — | X |
| Comparative Example 8 | 2.7 | 0.98 | 480 | 0.23 | X | Δ | Δ | X | X |

As will be apparent from Table 4, the liquid developer according to the embodiment of the invention has excellent fixing strength, dispersion stability, and preservation property. In contrast, in a case of the liquid developer of each comparative example, satisfactory results were not obtained. Further, it was confirmed that, in each example, the fatty acid monoester and the dispersant were being unevenly distributed on the surfaces of the toner particles in resultant liquid developer. In addition, since the dispersant was being unevenly distributed on the surfaces of the toner particles, even when the evaluation of fixing strength, dispersion stability, and preservation property were performed on the strict condition as described above, excellent fixing strength, dispersion stability, and preservation property. In contrast, in the comparative examples, the uneven distribution of the fatty acid monoester was not confirmed.

Further, in respect to the liquid developer manufactured in each example, image formation was performed on a recording medium (J paper manufactured by Fuji Xerox Office Supply) with an image forming apparatus including the liquid developing device shown in FIG. 1 and the fixing device shown in FIG. 3 in a state where the fixing temperature of the fixing device was set to 180° C., the feed rate of the recording medium was set to 30 sheets/min, and the linear pressure by the pressure roller was set to 480 g/cm. Then, a high-definition toner image with 1200 dpi resolution was obtained without causing thin spot and irregularity. In addition, the evaluation of the fixing strength about the resultant toner image was performed on the same evaluation standard as described above, and then an excellent fixing strength was confirmed.

While changing the fixing temperature of the fixing device to 160° C., 140° C., 120° C., and 100° C., the fixing strength was evaluated in the same manner as described above, and the same results were obtained. From this viewpoint, it can be seen that the liquid developer according to the invention is suitable for low-temperature fixation.

While increasing the feed rate of the recording medium of the fixing device from 30 sheets/min to 40 sheets/min, 50 sheets/min, and 60 sheets/min, the fixing strength was evaluated in the same manner as described above, and the same results were obtained. From this viewpoint, it can be seen that the liquid developer according to the embodiment of the invention is suitable for high-speed printing.

While changing the linear pressure by the pressure roller of the fixing device from 480 g/cm to 240 g/cm, the fixing strength was evaluated in the same manner as described above, and the same results were obtained. From this viewpoint, it can be seen that, even though a high linear pressure is not applied, a sufficient fixing strength can be obtained. In addition, it can be seen that the liquid developer according to the embodiment of the invention can be suitably applied to the above-described image forming apparatus.

When the liquid developing device shown in FIG. 2 had been used to perform image formation in the same manner, the same results were obtained.

Further, when the fixing device shown in FIG. 4 had been used to perform image formation in the same manner, the same effects were obtained. Further, even though image formation is performed in a state where a feed rate of the recording medium of the fixing device is 60 sheets/min and the fixing temperature is set to 100° C., the same results were obtained. From this viewpoint, when the fixing device shown in FIG. 4 uses the liquid developer of each example, it can be particularly suitable for low-temperature fixing and high-speed printing.

In addition, when a liquid developer was manufactured and evaluated in the same manner as described above, except that pigment red 122, pigment yellow 180, or carbon black (Printex L manufactured by Degussa Corporation), instead of the cyanogen-based pigment, was used as the colorant, the same results as described above were obtained.

The entire disclosure of Japanese Patent Application Nos: 2006-50889, filed Feb. 27, 2006 and 2006-288140, filed Oct. 23, 2006 are expressly incorporated by reference herein.

What is claimed is:

1. A liquid developer comprising:

an insulation liquid; and toner particles that are dispersed in the insulation liquid, wherein fatty acid monoester is unevenly distributed in the vicinity of surfaces of the toner particles, and the insulation liquid contains unsaturated fatty acid triglyceride.

2. The liquid developer according to claim 1, wherein a dispersant is unevenly distributed in the vicinity of the surfaces of the toner particles, together with fatty acid monoester.

3. The liquid developer according to claim 2, wherein the content of the dispersant in the liquid developer is in a range of 0.10 to 3.0 wt %.

4. The liquid developer according to claim 2, wherein, when the content of the dispersant in the liquid developer is A [wt %] and the content of the toner particles is B [wt %], the relationship $0.006 \leqq A/B \leqq 0.12$ is satisfied.

5. The liquid developer according to claim 2, wherein the dispersant is a polymer dispersant.

6. The liquid developer according to claim 1, wherein viscosity of fatty acid monoester is 10 mPa·s or less.

7. The liquid developer according to claim 1, wherein the liquid developer contains saturated fatty acid having the number of carbon atoms ranging from 8 to 18 as fatty acid monoester.

8. The liquid developer according to claim 1, wherein the liquid developer contains unsaturated fatty acid ester as fatty acid monoester.

9. The liquid developer according to claim 1, wherein a resin material forming the toner particles is polyester resin.

10. A method of manufacturing a liquid developer, the method comprising:

milling a toner material mainly composed of a resin material in fatty acid monoester to obtain a milled material dispersion liquid; and mixing the milled material dispersion liquid and the liquid containing unsaturated fatty acid triglyceride.

11. The method according to claim 10, wherein the milling mills the toner material in the fatty acid monoester, to which a dispersant is added.

12. An image forming apparatus comprising:

a liquid developer storage unit that stores a liquid developer;

a developing unit that develops using the liquid developer supplied from the liquid developer storage unit;

a transfer unit that transfers an image formed on the developing unit to a recording medium so as to form a transfer image on the recording medium; and a fixing unit that fixes the transfer image formed on the recording medium onto the recording medium, wherein, in the liquid developer, toner particles are dispersed in an insulation liquid, fatty acid monoester is unevenly distributed in the vicinity of surfaces of the toner particles, and the insulation liquid contains unsaturated fatty acid triglyceride.

* * * * *